US005718527A

United States Patent [19]

Fujimoto et al.

[11] Patent Number: 5,718,527

[45] Date of Patent: Feb. 17, 1998

[54] PAPER DELIVERY SYSTEM

[75] Inventors: Tetsuya Fujimoto; Yoshito Fukata; Tatsuhiro Taniwa; Hirotoshi Ikuta; Hiroshi Kishimoto, all of Hyogo; Yasushi Mouri, Tokyo; Masakazu Meguro, Kanagawa; Tsutomu Nagatomi, Hyogo, all of Japan

[73] Assignee: Fujitsu Limited, Kanagawa, Japan

[21] Appl. No.: 536,850

[22] Filed: Sep. 29, 1995

[30] Foreign Application Priority Data

| | | | |
|---|---|---|---|
| Oct. 28, 1994 | [JP] | Japan | 6-265777 |
| Mar. 30, 1995 | [JP] | Japan | 7-074062 |

[51] Int. Cl.[6] ..... B41J 11/32

[52] U.S. Cl. ..... 400/616.1; 226/75

[58] Field of Search ..... 400/616, 616.1, 400/616.2, 616.3; 226/74, 75, 76, 79

[56] References Cited

U.S. PATENT DOCUMENTS

| | | | |
|---|---|---|---|
| 3,420,352 | 1/1969 | Moran et al. | 400/616.1 |
| 3,578,138 | 5/1971 | Cantwell | 400/616.1 |
| 5,354,139 | 10/1994 | Barrus et al. | 400/616.1 |

FOREIGN PATENT DOCUMENTS

| | | | |
|---|---|---|---|
| 0141545 | 5/1985 | European Pat. Off. | 400/616.1 |
| 2164215 | 1/1980 | Germany | 400/616.1 |
| 0137982 | 10/1981 | Japan | 400/616.1 |

OTHER PUBLICATIONS

IBM Technical Disclosure Bulletin; vol. 15, No. 1, Jun. 1972 "Bidirectional Printer Carriage".

IBM Technical Disclosure Bulletin; vol. 32, No. 5B, Oct. 1989 "Forms Carriage Horizontal Vernier".

*Primary Examiner*—Christopher A. Bennett

*Attorney, Agent, or Firm*—Armstrong, Westerman, Hattori, McLeland & Naughton

[57] ABSTRACT

A paper delivery system having a printing unit with an upstream tractor and a downstream tractor disposed on an upstream side and a downstream side, respectively, of the paper delivery unit in the direction of paper delivery, a coupler coupling the upstream tractor and the downstream tractor to each other and a support shaft for supporting the coupler so that the coupler is movable in a direction transverse to the paper delivery direction and a resilient member positioned between the coupler and a fixed frame of the printing unit for energizing the coupler in a predetermined direction for constantly holding the coupler at a certain position in relation to the support shaft.

5 Claims, 27 Drawing Sheets

PAPER DELIVERY SYSTEM

BACKGROUND OF THE INVENTION (1) Field of the Invention

The present invention relates to paper delivery systems, and more particularly, to a paper delivery system comprised of delivery means disposed on upstream and downstream sides of a printing unit with respect to a paper delivery direction.

(2) Description of the Prior Art

There have been widely known so-called double-tractor type paper delivery systems for use in image forming apparatus in which continuous forms paper is used as chart. In such paper delivery systems, tractors, which are brought into engagement with the tractor holes of continuous forms paper to deliver the paper, are arranged on the upstream and downstream sides of the printing unit respectively.

FIG. 31 shows one example of the double-tractor type paper delivery systems. This paper delivery system comprises (i) a paper hopper 102 in which continuous forms paper (hereinafter referred to as "paper") 101 is stacked, (ii) a printing unit comprised of a printing head 103 for printing images on the surface of the paper 101 sent from the paper hopper 102 and of a platen 104, and (iii) a paper stacker 105 onto which the paper 101 carrying images printed by the printing unit is stacked. There are provided an upstream tractor (i.e., lower tractor) 106 positioned upstream the printing unit and a downstream tractor (i.e., upper tractor) 107 positioned downstream the printing unit. A back tension roller 108 is arranged between the upstream tractor 106 and the printing unit, for applying back tension to the paper 101 being delivered to the printing unit. In this paper delivery system having such components, the paper 101 is loaded by putting the tractor hole at the lead end of the paper 101 on a tractor pin of the upstream tractor 106. After loading, the upstream tractor 106 and the downstream tractor 107 are synchronously driven to deliver the paper 101 in the direction of arrow A, images are printed on the paper 101, and the paper 101 is then stacked on the paper stacker 105, being sequentially folded according to the perforations formed on the paper 101.

SUMMARY OF THE INVENTION

The above-described conventional paper delivery system are subject to at least a couple of drawbacks. First, the tractor pin of the downstream tractor sometimes cannot be smoothly inserted into the tractor hole defined at the lead end of the paper when automatic loading is performed prior to a start of printing, and this causes paper jam in some cases. Second, deflection of the tractor holes in relation to the tractor pins causes deterioration in print quality. Third, when the tractors are operated to move in a direction parallel to the width of the paper in accordance with the size of the paper, it is difficult to position the tractor pins and the tractor holes so as to fit to each other. Another problem is that the system exhibits poor operability particularly when the downstream tractor is manually rotated by the use of a paper delivery knob.

The present invention has been made to overcome the foregoing problems and one of the objects of the invention is therefore to provide a paper delivery system which achieves easy, reliable automatic paper loading, improved operability in setting paper in the paper delivery system and an improvement in print quality by eliminating displacement during paper delivery.

According to a first aspect of the invention, there is provided a paper delivery system wherein an upstream tractor and a downstream tractor are disposed on upstream and downstream sides of a printing unit respectively with respect to a paper delivery direction, the system comprising a paper lead end detection sensor disposed in the downstream tractor for detecting a lead end of paper being delivered.

According to the first form of the invention, paper can be securely sent to the downstream tractor and the lead end of the paper is detected while fluttering of the paper is prevented, so that improved detection accuracy can be achieved. In addition, reliable detection of the paper lead end can be performed without the use of a number of detection sensors, so that the number of components employed in the system can be reduced, leading to cost reduction.

In the first form of the invention, the paper lead end detection sensor preferably comprises (i) a sensor lever that pivots when pressed by the lead end of the delivered paper and (ii) a shield that pivots, following the pivot of the sensor lever, between an interrupt position where light projected from a transmission-type photosensor is interrupted by the shield and a transmit position where the light is transmitted without interruption. In this case, it is preferable that the sensor lever be curved upward with a base end and a lead end that are always positioned lower than a paper delivery path. The contact face of the sensor lever with respect to the paper is preferably positioned in a vertical plane or in a plane slightly inclined in the paper delivery direction in relation to a vertical plane, before it comes in contact with the paper.

By providing the paper lead end detection sensor to be a photosensor utilizing a lever as noted earlier, it positively prevents erroneous detection even if the position at which the paper strikes against the sensor lever varies. Further, this prevents the lead end of the sensor lever from being caught by a binding hole of the paper or the like during paper delivery in the reverse direction, so that not only tearing of the paper but also breakage of the sensor lever can be prevented.

Preferably, the downstream tractor is provided with a delivery guide for guiding the top face of the paper delivered. The delivery guide may include a guide rib which projects downward and extends in the paper delivery direction. The provision of the guide rib narrows the width of the delivery path at the positions before and behind the sensor lever. This allows the paper to constantly strike against the sensor lever at the same position, and as a result, detection errors can be positively prevented.

Optionally, the downstream tractor may be provided with a jam detection sensor that is rotated when it comes in contact with the delivered paper, thereby detecting paper jam.

According to a second aspect of the invention, there is provided a paper delivery system wherein an upstream tractor and a downstream tractor are disposed on upstream and downstream sides of a printing unit respectively with respect to a paper delivery direction, wherein the downstream tractor has a delivery guide for guiding a top face of paper being delivered, and wherein the delivery guide has a paper entrapment section whose upstream end with respect to the paper delivery direction is bent upward.

According to the second form of the invention, when loading the paper in the downstream tractor by automatic loading, the paper is smoothly inserted in the downstream tractor, which improves automatic loading performance.

Further, since there is no need to form the delivery guide as a separate part, manufacturing cost can be reduced.

According to a third aspect of the invention, there is provided a paper delivery system wherein an upstream tractor and a downstream tractor are disposed on upstream and downstream sides of a printing unit respectively with respect to a paper delivery direction, wherein the number of tractor pins provided in the upstream tractor is less than the number of tractor pins provided in the downstream tractor.

According to the third form of the invention, setting of the paper relative to the upstream tractor can be easily performed, which leads to an improvement in the operability of the system.

According to a forth aspect of the invention, there is provided a paper delivery system wherein an upstream tractor and a downstream tractor are disposed on upstream and downstream sides of a printing unit respectively with respect to a paper delivery direction, the system comprising a coupler for coupling the upstream tractor and the downstream tractor to each other, and a support shaft for supporting the coupler such that the coupler is movable in a direction transverse to the paper delivery direction.

According to the forth form of the invention, the upstream and downstream tractors can be easily, smoothly moved in a lateral direction in accordance with the width of the paper which improves the operability of the system when setting the paper.

In the forth form, there may be provided a lock shaft which penetrates through at least either the upstream tractor or the downstream tractor, and a lock means for locking the tractor through which the lock shaft penetrates to the lock shaft. Preferably, the lock shaft and the lock means are provided only for the downstream tractor.

Optionally, a resilient member is provided between the coupler and a fixed frame for energizing the coupler in a predetermined direction to constantly hold the coupler at a certain position in relation to the support shaft. This arrangement eliminates backlash between the coupler and the support shaft, thereby preventing the displacement of the upstream tractor and the downstream tractor.

The upstream tractor or downstream tractor may be secured to at least one claw member by means of a screw, the claw member being disposed on the coupler so as to project therefrom. Alternatively, the upstream tractor or downstream tractor may be secured to the coupler, being pinched by two claw members disposed on the coupler so as to project therefrom.

According to a fifth aspect of the invention, there is provided a paper delivery system wherein an upstream tractor and a downstream tractor are disposed on upstream and downstream sides of a printing unit respectively with respect to a paper delivery direction, the system comprising a paper delivery knob disposed so as to partly project upward from a hole defined in a machine body cover, for rotating a rotary shaft of the downstream tractor through manual operation.

According to the fifth form of the invention, the paper delivery knob can be installed in a narrow space, thereby to restrain the width of the system and to improve the operability of the system.

In the fifth form, a table may be provided on a side of the machine body cover adjacent the paper delivery knob for supporting an operator's hand placed thereon.

According to a six aspect of the invention, there is provided a paper delivery system wherein an upstream tractor and a downstream tractor are disposed on upstream and downstream sides of a printing unit respectively with respect to a paper delivery direction, and wherein the phase of tractor pins disposed in the downstream tractor is shifted from the phase of tractor pins disposed in the upstream tractor by a length which is less than the pitch of tractor holes formed in paper.

According to the six form of the invention, the paper can be smoothly inserted into the downstream tractor during, for example, automatic paper loading, which contributes to an improvement in operability as well as in print quality.

According to a seventh aspect of the invention, there is provided a paper delivery system wherein upstream delivery means and downstream delivery means are disposed on upstream and downstream sides of a printing unit respectively with respect to a paper deliver), direction, and wherein delivery rollers are disposed between the upstream delivery means and the printing unit for delivering paper pinched therebetween, the system comprising a first control means for performing control during automatic loading of the paper such that the deliver), rollers are driven at a speed equal to or faster than the speed of the upstream delivery means and the downstream delivery means during automatic loading, and such that the delivery rollers are stopped upon completion of automatic loading at which the lead end of the paper reaches a predetermined position.

According to the seventh form of the invention, during automatic loading, the paper is delivered on the basis of the upstream delivery means, and after completion of automatic loading, the paper is delivered on the basis of the downstream delivery means. With this arrangement, the paper can be smoothly loaded onto the downstream delivery means. As printing is performed while tension is applied to the paper positioned between the downstream delivery means and the delivery rollers, print quality can be improved.

Preferably, the first control means controls the platen of the printing unit such that during automatic loading, the platen is retracted from the paper delivery path, and such that after completion of automatic loading, the gap between the platen and the printing head is adjusted. In this case, the upstream delivery means and the downstream delivery means may be tractors for delivering the paper with pins engaged with the tractor holes of the paper. The distance of the paper delivery path between the above predetermined position and a printing position where printing is performed by the printing unit may be equal to the length obtained by adding half of the pitch of the tractor holes of the paper to a multiple of the pitch. The gap adjustment by the first control means may be performed over the tractor holes. With such arrangement, the gap adjustment can be performed in a good condition without being affected by perforations, paper stapler or glue, so that an appropriate gap can be achieved in the printing unit, resulting in an improvement in print quality. This also prevents troubles such as a snap of the printing head pin.

The aforesaid predetermined position may be a marked position in the delivery guide of the downstream tractor.

The seventh form preferably includes a second control means for performing control when jamming of the paper is detected during automatic loading such that the lead end of the paper is sent back to the position of the upstream delivery means to restart automatic loading. The second control means may be designed to generate a warning signal for informing a jammed condition when paper jam cannot be eliminated even if execution of automatic loading is repeated a predetermined number of times.

According to an eighth aspect of the invention, there is provided a paper delivery system wherein upstream delivery means and downstream delivery means are disposed on upstream and downstream sides of a printing unit respectively with respect to a paper delivery direction and wherein delivery rollers are disposed between the upstream delivery means and the printing unit for delivering paper pinched therebetween, the system comprising a third control means for performing control during normal printing such that printing is started after the paper has been forwardly delivered by the upstream delivery means and the downstream delivery means according to page length data on the paper after completion of automatic loading until a printing position where printing is performed by the printing unit coincides with a position at a head of a page at which printing is started.

According to the eighth form of the invention, the print starting position of the paper always comes to the printing position after automatic loading. Even if the paper is erroneously set, the lead end of the paper is brought in line with the automatic loading end position thereby to bring the print starting position of the paper to the printing position.

In the eighth form, the third control means may perform control such that if the print starting position of the paper is positioned downstream the printing unit with respect to the paper delivery direction after completion of automatic loading, printing is started after the paper has been backwardly delivered by the upstream delivery means and the downstream delivery means according to the page length data on the paper as far as the paper does not come off the downstream delivery means until the print starting position of the paper coincides with the printing position. This minimizes waste of the paper.

According to a ninth aspect of the invention, there is provided a paper delivery system wherein upstream delivery means and downstream delivery means are disposed on upstream and downstream sides of a printing unit respectively with respect to a paper delivery direction and wherein delivery rollers are disposed between the upstream delivery means and the printing unit for delivering paper pinched therebetween, the system comprising a fourth control means for performing control during top page printing of the paper such that printing is started after the paper has been backwardly delivered by the upstream delivery means and the downstream delivery means with the delivery rollers being stopped, from a condition where the lead end of the paper is positioned on the downstream delivery means until the lead end of the paper is brought in line with a printing position where printing is performed by the printing unit.

According to the ninth form of the invention, when instruction for executing top page printing (i.e., printing which starts from the top page of the paper) has been released, the paper is backwardly delivered after completion of automatic loading until the lead end of the paper is brought into line with the printing position whereupon printing is started. Thus, printing can be started from the lead end (i.e., top page) of the paper so that waste of the paper can be prevented.

The fourth control means in the ninth form preferably performs control such that when reversely delivering the paper by the upstream delivery means and the downstream delivery means, the paper is delivered excessively by a specified distance equivalent to the length of backlash and then the upstream delivery means, the downstream delivery means and the delivery rollers are forwardly moved by the above specified distance, and thereafter, printing is started. Such arrangement prevents backlash caused in the mechanism from affecting printing operation, the backlash being resulted from the forward delivery and backward delivery of the paper performed in combination. This also leads to an improvement in print quality.

The fourth control means preferably performs control such that during top page printing of the paper, the delivery rollers are driven at a speed equal to or faster than the speed of the upstream delivery means and the downstream delivery means, and such that the delivery rollers are stopped when the lead end of the paper reaches the position of the downstream delivery means. In this way, before the paper reaches the downstream delivery means, the paper is delivered on the basis of the upstream delivery means. After the paper has reached the downstream delivery means, the paper is delivered being tensioned between the delivery rollers and the downstream delivery means.

The fourth control means may perform control to drive the upstream delivery means and the downstream delivery means after stop of the delivery rollers by an amount equal to the deflection of the paper caused between the delivery rollers and the downstream delivery means. With this arrangement, correction is performed by an amount equal to the phase difference between the upstream delivery means and the downstream delivery means so that print quality can be improved.

The fourth control means may perform control to stop the delivery rollers when a margin between pages of the paper reaches the printing position where printing is performed by the printing unit after the lead end of the paper has reached the position of the downstream delivery means. With such arrangement, when a margin between pages which is not a printing area comes to the printing position, correction is performed by an amount equal to the phase difference between the upstream delivery means and the downstream delivery means so that print shifts do not occur on the same page.

Preferably, the fourth control means performs control to interrupt top page printing performed by the printing unit irrespective of whether a top page printing instruction has been released, on condition that the thickness of the paper which has been preliminarily detected is less than a predetermined value. In addition, the control means may control to interrupt top page printing performed by the printing unit irrespective of whether a top page printing instruction has been released, on condition that the width of the paper which has been preliminarily detected is less than a predetermined value. In this way, top page printing can be interrupted in cases where paper lacking in firmness is used. This prevents troubles such as a snap of the printing head pin or paper jam.

The fourth control means may perform control such that the gap between the platen and the printing head in the printing unit is appropriately adjusted each time one-line printing is performed during top page printing, and such that paper delivery is carried out with the gap widened. This eliminates the deflection of the paper during paper delivery so that good print quality can be ensured. Even if a medium composed of sheets irregular in level (hereinafter referred to as "irregular-level medium")is first printed, printing can be smoothly performed.

In this case, it is preferable that the gap adjustment after every one-line printing be performed on condition that the thickness of the paper which has been preliminarily detected is not less than the predetermined value, or on condition that the width of the paper preliminarily detected is not less than a predetermined value.

The upstream delivery means and the downstream delivery means may each be tractors for delivering the paper with pins engaged with the tractor holes of the paper. Alternatively, the upstream delivery means may be a tractor for delivering the paper with pins engaged with the tractor holes of the paper, while the downstream delivery means may be paper send rollers for delivering the paper pinched therebetween.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and accompanying drawings which are given by way of illustration only, and thus do not limit the present invention, and wherein:

FIG. 1 is a side view of an impact printer according to one embodiment of the invention;

FIG. 2 is a partial plan view of the impact printer according to the embodiment of the invention;

FIG. 3 is a right side view of a downstream tractor;

FIG. 4 is a left side view of the downstream tractor;

FIG. 5 is a partial plan view of the downstream tractor;

FIG. 6 is a partially enlarged sectional view of the downstream tractor;

FIGS. 7(*a*) and 7(*b*) are explanatory diagrams of a lock mechanism;

FIG. 8 is a schematic perspective view of a tractor slide mechanism;

FIG. 9 is a partial side view of the tractor slide mechanism;

FIG. 10 shows the structure of a support section of a tractor slide mechanism according to one modified example;

FIG. 11 shows the structure of a support section of a tractor slide mechanism according to another modified example;

FIG. 12 is a plan view showing the installed position of a paper delivery knob;

FIG. 13 is an explanatory view showing the paper delivery knob in operation;

FIG. 14 is a side view of the paper delivery knob;

FIG. 15 is a flow chart of control operation during automatic loading of paper;

FIG. 16 is an explanatory view showing paper in its slack condition during automatic loading;

FIG. 17 is an explanatory view showing the paper in its slack condition after completion of automatic loading;

FIG. 18 is an explanatory view showing the relationship between the stop position of the paper after automatic loading and a printing position;

FIG. 19 is a perspective view of an automatic printing gap adjustment mechanism;

FIG. 20 is an explanatory view showing one example of measurement of the thickness of the paper;

FIG. 21 is a flow chart of control operation during printing after automatic loading of paper;

FIG. 22 is a flow chart of control operation during top page printing;

FIG. 23 is a flow chart of control operation during top page printing according to a modified example;

FIG. 24 is a flow chart of control operation for print shift correction;

FIG. 25 is a flow chart of control operation for print shift correction according to another example;

FIG. 26 shows a paper width detection mechanism according to one example;

FIG. 27 is a flow chart of control operation during top page printing of an irregular-level medium;

FIG. 28 is a flow chart of control operation during top page printing of an irregular-level medium according to a modified example;

FIG. 29 shows paper delivery means according to another example;

FIG. 30 is a side view of a delivery guide mechanism; and

FIG. 31 shows a double-tractor type paper delivery system according to prior art.

DESCRIPTION OF THE PREFERRED EMBODIMENTS

Figure 1:
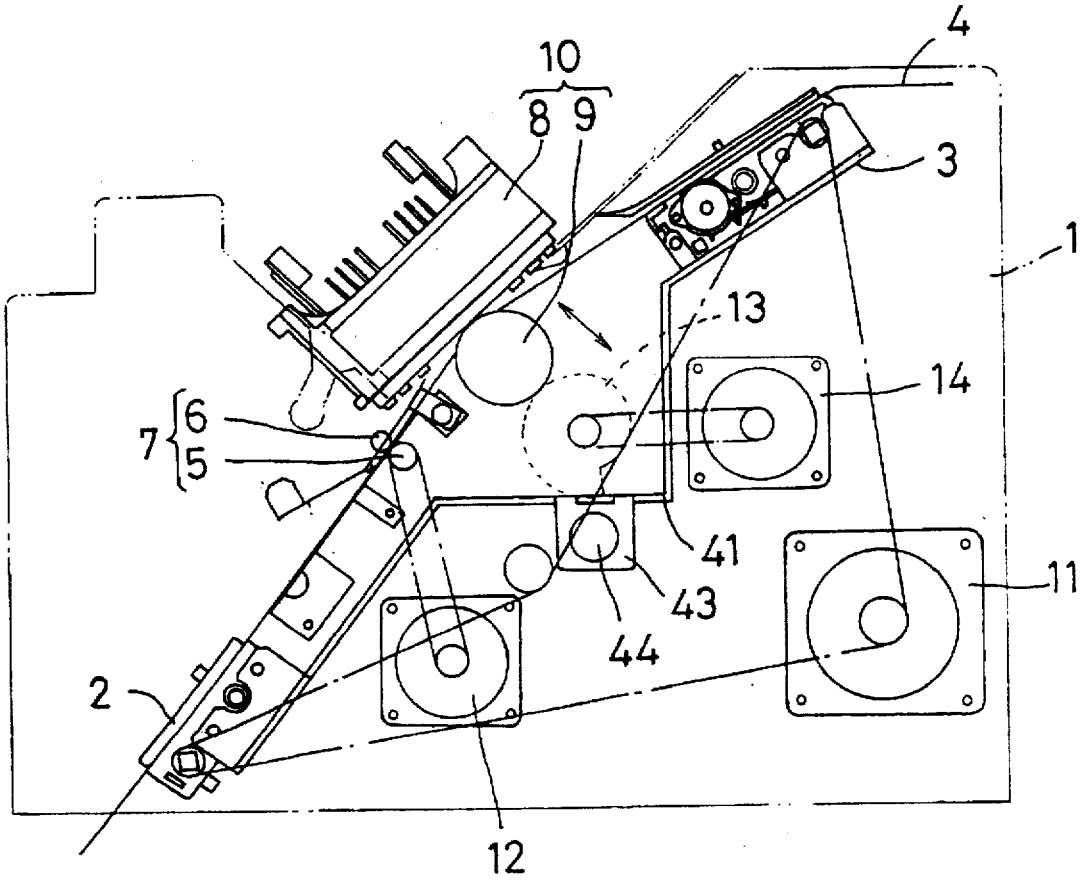
FIGS. 1 to 31 associate with preferred embodiments of a paper delivery system according to the invention.

Referring now to the drawings, preferred embodiments of a paper delivery system according to the invention will be explained below.

Figure 2:
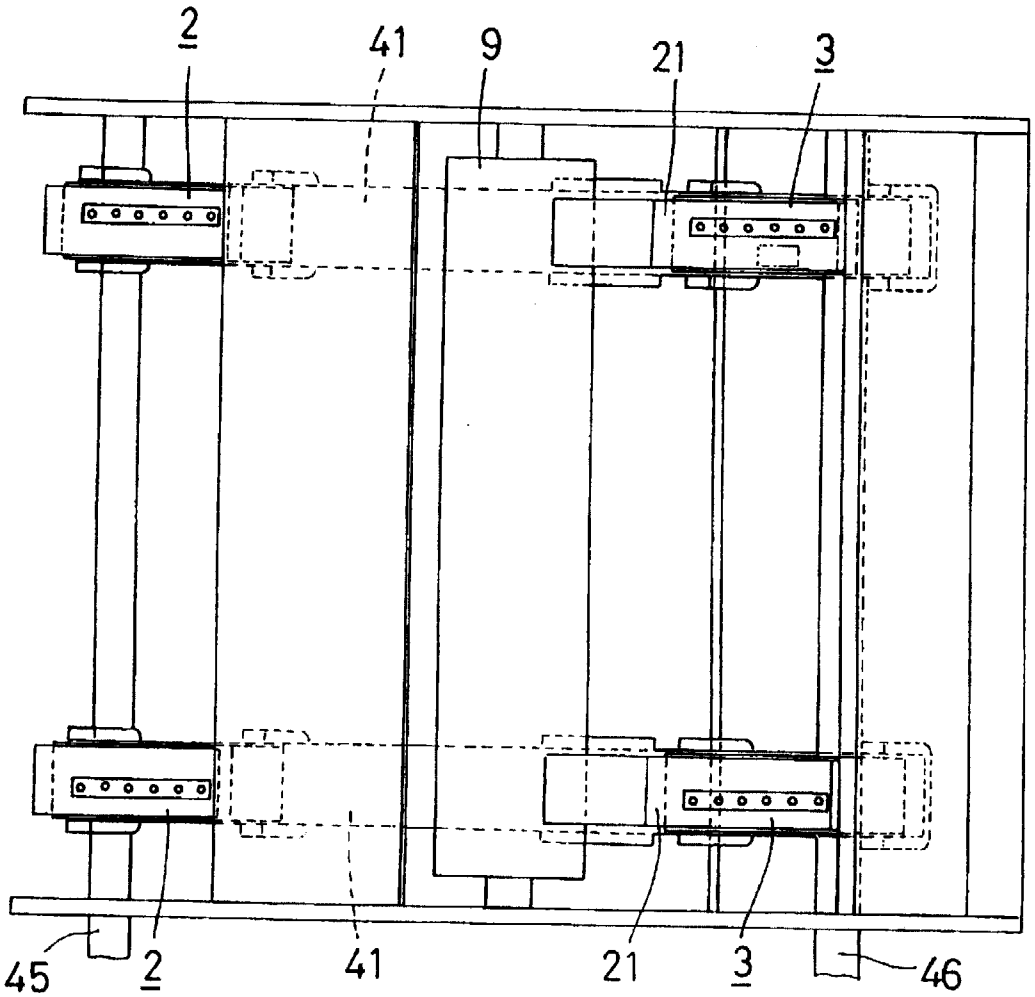

FIGS. 1 and 2 show the side view and partial plan view of an impact printer according to one embodiment of the invention. As shown in these figures, the impact printer of this embodiment comprises an upstream tractor (lower tractor) 2 positioned at a front lower part (at the left hand in FIG. 1) within a machine body frame 1, a downstream tractor (upper tractor) 3 positioned at a rear upper part (at the right hand in FIG. 1) within the machine body frame 1, and a paper hopper (not shown) positioned under the upstream tractor 2 for storing paper 4 placed thereon. The upstream tractor 2 and downstream tractor 3 are respectively composed of a pair of members laterally aligned. Disposed between the upstream tractor 2 and the downstream tractor 3 are delivery rollers 7 composed of a drive roller 5 and a pinch roller 6. On the downstream side of the delivery rollers 7, there is provided a printing unit 10 comprising a printing head 8 and a platen 9.

The upstream tractor 2 and the downstream tractor 3 are synchronously driven by a first delivery motor 11 while the drive roller 5 is driven by a second delivery motor 12. A cam 13 is disposed under the platen 9 as to be in sliding contact with the peripheral face of the platen 9. The cam 13 is rotated by a stepping motor 14, whereby the position of the platen 9 in relation to the printing head 8 is adjusted. The paper 4 which has been fed from the paper hopper travels through a delivery path which passes the upstream tractor 2, delivery rollers 7, printing unit 10 and downstream tractor 3. During paper delivery, images are printed on the surface of the paper 4 by the printing head 8 in the printing unit 10.

Next, the tractor construction, tractor slide mechanism, paper delivery knob construction, paper delivery control unit and delivery guide mechanism of the impact printer according to this embodiment will be concretely described in order.

(1) Tractor construction

Figure 3:
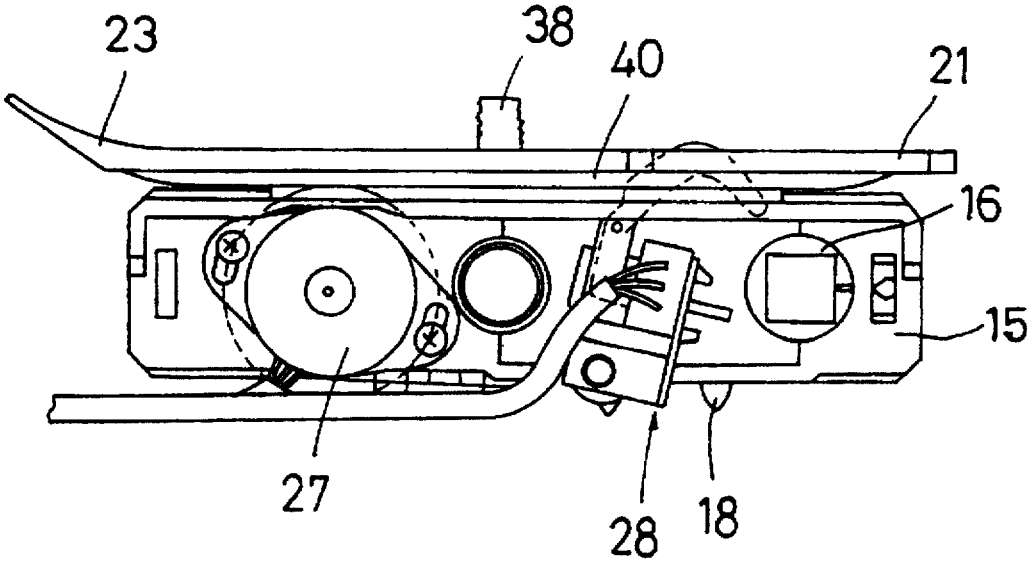
Figure 4:
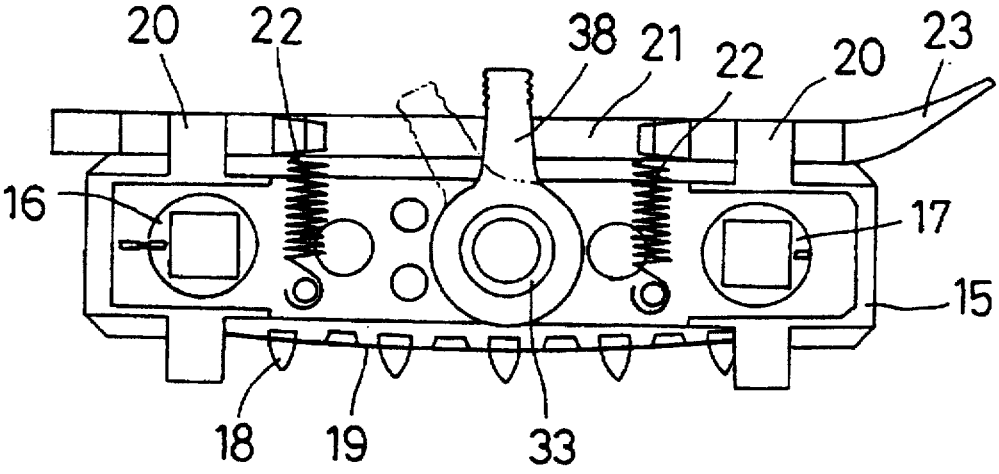
Figure 5:
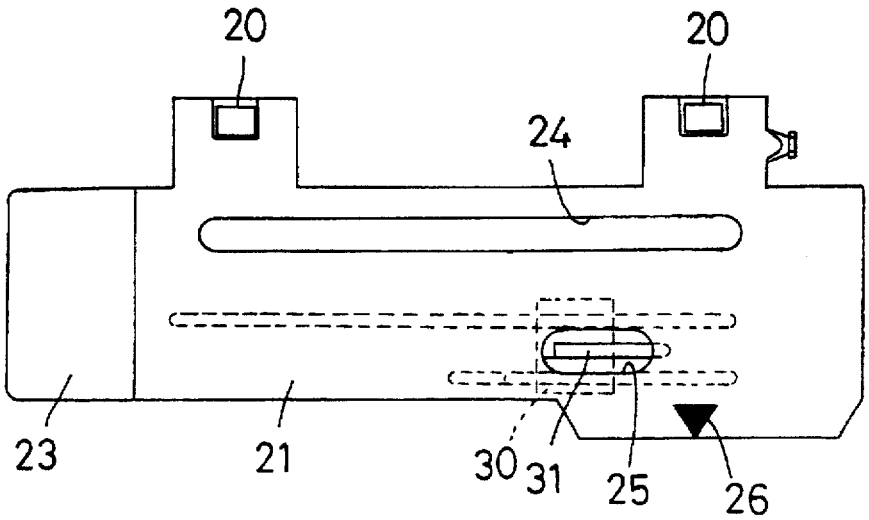
Figure 6:
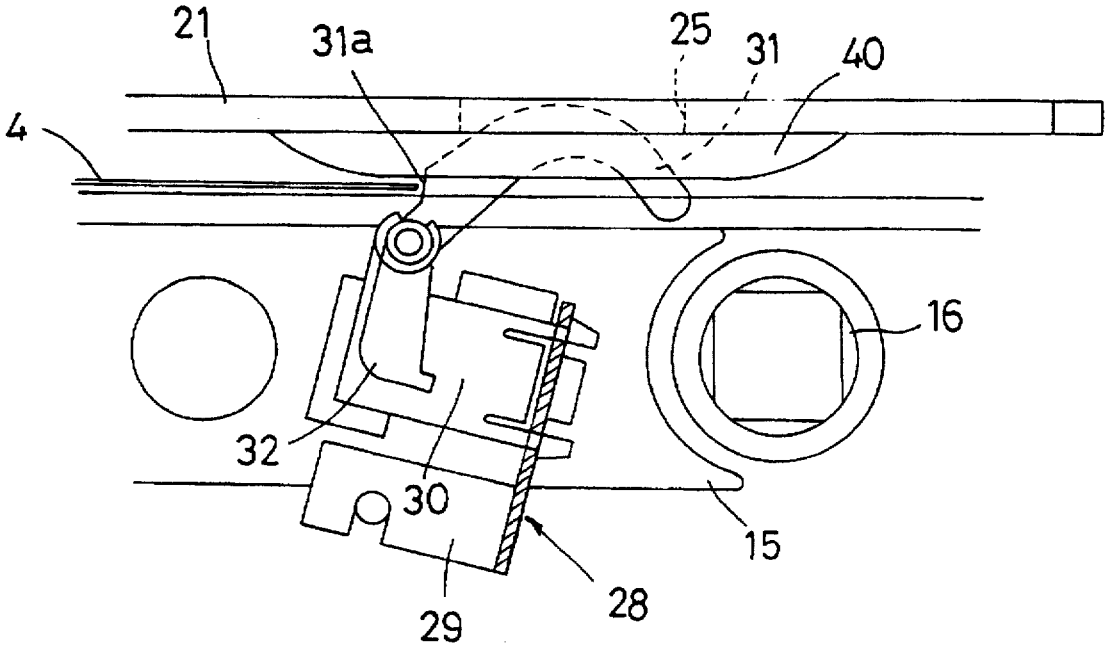

The structure of the downstream tractor 3 will be mainly described. The right side view and left side view of the downstream tractor 3 are shown in FIG. 3 and FIG. 4, respectively. FIG. 5 is a plan view showing only the structure of the essential part of the downstream tractor 3, and FIG. 6 is a partially enlarged sectional view of the downstream tractor 3.

In the downstream tractor 3, a tractor drive shaft 16 and a tractor guide shaft 17 are rotatably supported at the front and rear parts of a base 15 respectively. A pin belt 19 having a plurality of tractor pins 18 (15 tractor pins in this embodiment) planted in its periphery is hung over the tractor drive shaft 16 and the tractor guide shaft 17 at the substantial centers thereof.

A tractor lid 21 serving as a lid as well as a delivery guide is attached to the base 15 by means of two hinges 20 positioned on the top face of the base 15. Tensioned between the tractor lid 21 and the base 15 are two coil springs 22. The coil springs 22 are so arranged to pass a dead point while the tractor lid 21 pivots from a closed position to an open position, so that the tractor lid 21 can be retained at the closed or open position. The tractor lid 21 has a paper entrapment section 23 which is bent up toward the upstream side with respect to a paper delivery direction. An opening 24 is formed at a position corresponding to the position of the tractor pins 18 aligned under the opening 24, while an opening 25 is formed at a position corresponding to the position of a sensor lever 31 of a paper lead end detection sensor 28 (described later). On the top face of the tractor lid 21, a mark 26 used for paper alignment is provided on the downstream side with respect to the paper delivery direction.

On the right side face of the base 15, a jam detection sensor 27 is disposed on the upstream side with respect to the paper delivery direction and the paper lead end detection sensor 28 used for delivery control is disposed on the downstream side with respect to the paper delivery direction. The jam detection sensor 27 is rotated by the paper 4 when the paper 4 is inserted into the downstream tractor 3, so that the sensor 27 can detect the paper 4 in its jam condition. The paper lead end detection sensor 28 has a sensor body 30. The sensor body 30 comprises a metal part 29 secured to the base 15 and a transmission-type photosensor having a U shape in section and composed of a light projector and a light receiver. The sensor lever 31 and a shield 32 are journaled in the sensor body 30 so as to pivot in an integral fashion. The sensor lever 31 pivots when it is pressed by the lead end of the paper 4 being delivered. The sensor lever 31 is curved upward such that the curved portion projects into the paper delivery path while its base end and lead end are always positioned under the paper delivery path. A face 31*a* of the sensor lever 31 comes in contact with the paper 4. This contact face 31*a* is formed by cutting and is positioned in a vertical plane or in a plane slightly inclined in the paper delivery direction in relation to a vertical plane before it comes in contact with the paper 4. The shield 32 is designed to pivot following the pivotal movement of the sensor lever 31. The shield 32 is located in a position where it interrupts light projected from the light projector of the sensor body 30 when it is in a normal condition, and pivots to a position where the light is allowed to be transmitted when the sensor lever 31 pivots.

Figure 7:
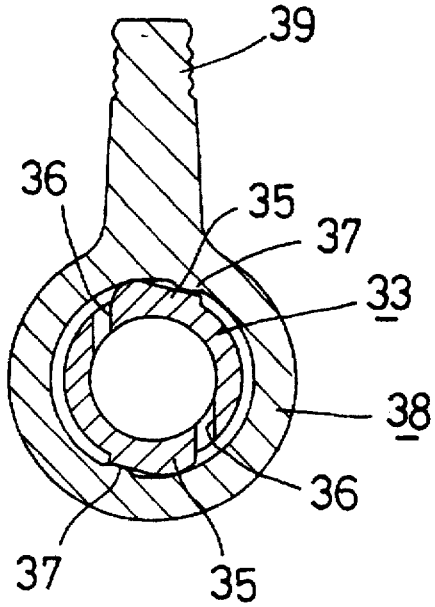
Figure 7:
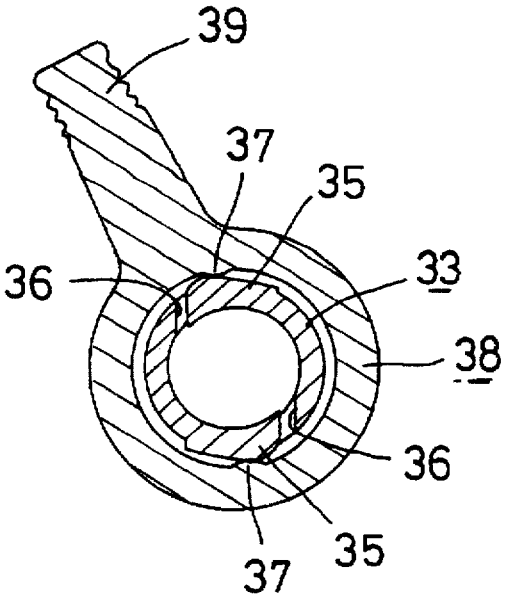

As shown in FIG. 4, a cylindrical lock body 33 is secured to the right member of the downstream tractor 3, the right member being located at the right hand when viewed in the paper delivery direction. A lock shaft 34 (see FIG. 8) is secured to the machine body frame 1, passing through the lock body 33. As shown in FIG. 7, the lock body 33 has two cam-shaped claws 35 and two notches 36 at the peripheral face thereof and is fitted in a lock lever 38 which has projections 37 at its inner periphery. These projections 37 are brought into engagement with the cam-shaped claws 35. In such a construction, when the projections 37 of the lock lever 38 are in contact with the lower parts of the cam-shaped claws 35 of the lock body 33, the lock body 33 is in an open state so that the lock shaft 34 is not locked by the lock body 33 (see FIG. 7(*a*)). In this state, if a knob 39 of the lock lever 38 is pivoted to allow the projections 37 of the lock lever 38 to come in contact with the higher parts of the cam-shaped claws 35 of the lock body 33, the lock body 33 will be compressed, thereby holding the lock shaft 34. As a result, the downstream tractor 3 is secured to the lock shaft 34 (see FIG. 7(*b*)).

In this embodiment, by virtue of the paper lead end detection sensor 28 provided for the downstream tractor 3, the lead end of the paper 4 can be detected in a condition where the paper 4 is securely delivered into the downstream tractor 3, and where fluttering of the paper 4 is prevented. This results in improved accuracy in the detection of the lead end of the paper 4. As the sensor lever 31 is designed such that its lead end is always positioned lower than the paper delivery path, the lead end of the sensor lever 31 is not entrapped in the binding holes of the paper 4 or the like, causing delivery troubles such as tearing of the paper 4 or breakage of the sensor lever 31, even when the paper 4 is delivered in the reverse direction. Further, as the contact face 31*a* is formed in a substantially vertical plane, the paper 4 can be brought into perpendicular contact with the sensor lever 31, which securely prevents detection errors.

According to this embodiment, a guide rib 40 is formed integrally with the right part of the underside of the tractor lid 21. This guide rib 40 projects toward the base 15 and extends in the paper delivery direction. The gap between the lower flange of the guide rib 40 and the top face of the base 15 is approximately 0.6 mm and forms a narrow part of the paper delivery path. With such arrangement, the lead end of the paper 4 comes in contact with the sensor lever 31 always at the same position, thereby to prevent detection errors when detecting the lead end of the paper 4 by the paper lead end detection sensor 28.

The jam detection sensor 27 and the paper lead end detection sensor 28 can exhibit their functions satisfactorily by simply attaching them to the left member of the downstream tractor 3, the left member being positioned at the left hand when viewed in the paper delivery direction.

The construction of the downstream tractor 3 has been mainly described in the foregoing description. The construction of the upstream tractor 2 is substantially identical to that of the downstream tractor 3, except that the upstream tractor 2 has neither the jam detection sensor 27 nor the paper lead end detection sensor 28, and that the tractor lid 21 has not the paper entrapment section 23.

Although only the downstream tractor 3 is locked to the lock shaft 34 in the forgoing embodiment, another lock shaft may be provided to lock the upstream tractor 2. It should be noted that the tractors 2 and 3 do not jar unexpectedly in the case of a single lock shaft as in the foregoing embodiment.

While the number of tractor pins 18 of the upstream tractor 2 is equal to the number of tractor pins 18 of the downstream tractor 3 in the forgoing embodiment, the former could be less than the latter. For example, the number of tractor pins 18 which come in engagement with the tractor holes of the paper 4 at the same time may be 6 pins for the downstream tractor 3 while 4 pins for the upstream tractor 2. Such arrangement facilitates paper setting at the time of automatic loading and allows the upstream tractor 2 to have a compact structure.

(2) Tractor slide mechanism

Figure 8:
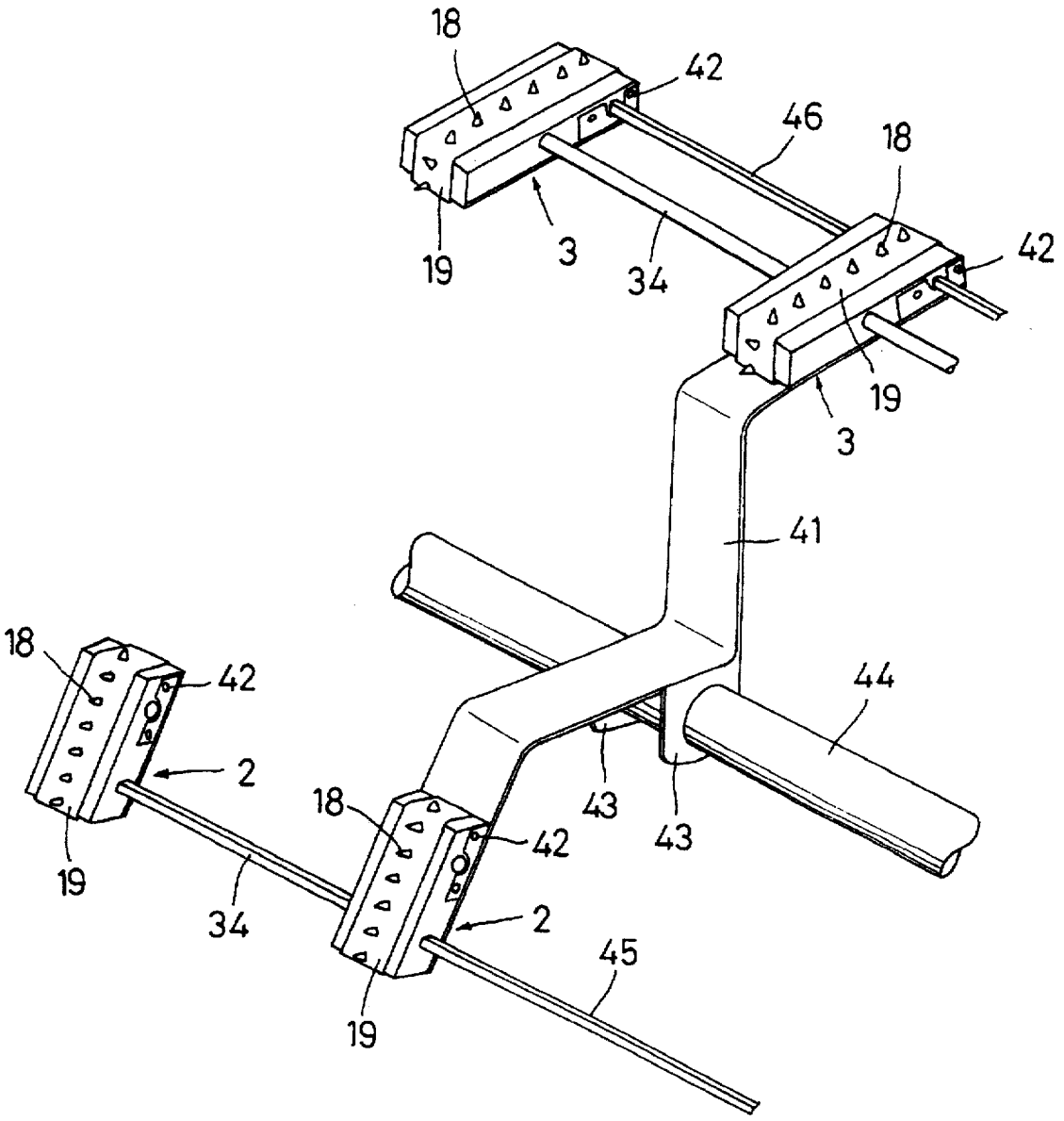

As shown in FIGS. 1 and 8, the right members of the upstream tractor 2 and the downstream tractor 2, which are positioned at the right hand when viewed in the paper delivery direction, are respectively integrally secured to claws 42, 42 by means of screws. The claws 42,42 are disposed at both ends of a coupler 41 for coupling the tractors 2 and 3. The coupler 41 is bent substantially at 90° at the center thereof and bent outwardly at an obtuse angle at both ends thereof. Attached to the portion bent substantially at 90° is a supporting bracket 43 through which a support shaft 44 penetrates, being fixed to the machine body frame 1. The coupler 41 is slidably supported to the support shaft 44 through a thrust ball bearing.

The right and left members of the upstream tractor 2,2 are driven by a drive shaft 45 which passes through piercing holes of a rectangular shape in section defined in the right and left members of the upstream tractor 2,2. Similarly, the right and left members of the downstream tractor 3,3 are driven by a drive shaft 46 which passes through piercing holes of a rectangular shape in section defined in the right and left members of the downstream tractor 3, 3.

The left members of the upstream tractor 2 and the downstream tractor 3, which are positioned at the left hand when viewed in the paper delivery direction, are secured to the machine body frame 1. These left members of the tractors 2, 3 are not coupled to each other. However, it is possible to employ such arrangement that the left members of the tractors 2, 3 are coupled to each other by means of a coupler 41 and are arranged so as to slide laterally along the support shaft 44 just like the right members of the tractors 2, 3, and that a lock mechanism similar to that of the right member is provided for the left members of the tractors 2, 3.

Figure 9:
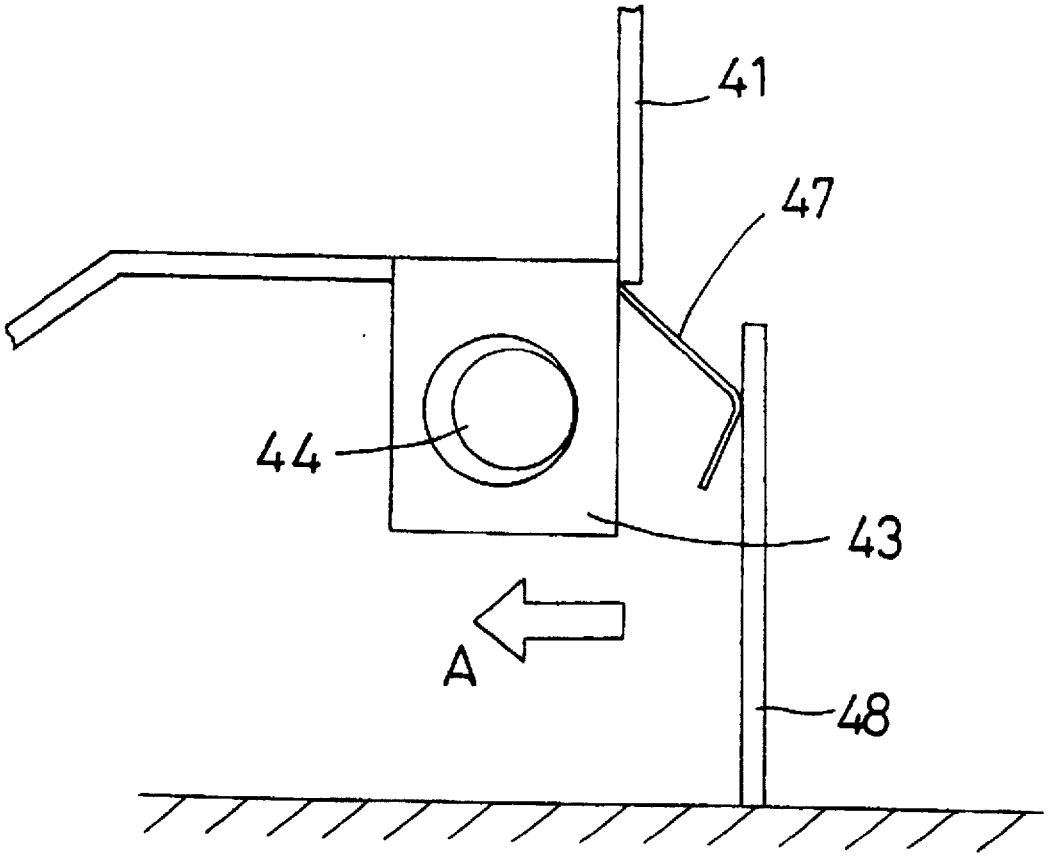

As shown in FIG. 9, a leaf spring 47 is attached to the back of the supporting bracket 43. The bent portion of the leaf spring 47 is always in contact with the front face of an upright board 48 on the machine body frame 1. Accordingly, a reaction force equal to the spring force of the leaf spring 47 is imparted to the supporting bracket 43 from the board 48 in the direction of arrow A. This prevents the displacement of the upstream tractor 2 and the downstream tractor 3 due to backlash between the support shaft 44 and the supporting bracket 43.

For adjusting the positions of the right members of the tractors 2, 3 according to the size (width) of the paper 4 by the use of the tractor slide mechanism having the above construction, the supporting bracket 43 is moved along the support shaft 44 by grasping the right member of the upstream tractor 2 to adjust the positions of the tractors 2, 3 laterally when the tractor 2 is released from the lock to the lock shaft 34 by the lock body 33, so that the tractor holes of the paper 4 can be hooked over the tractor pins 18 of the upstream tractor 2. Then, the lock lever 38 of the downstream tractor 3 is pivoted to fix the downstream tractor 3 to the lock shaft 34.

Figure 10:
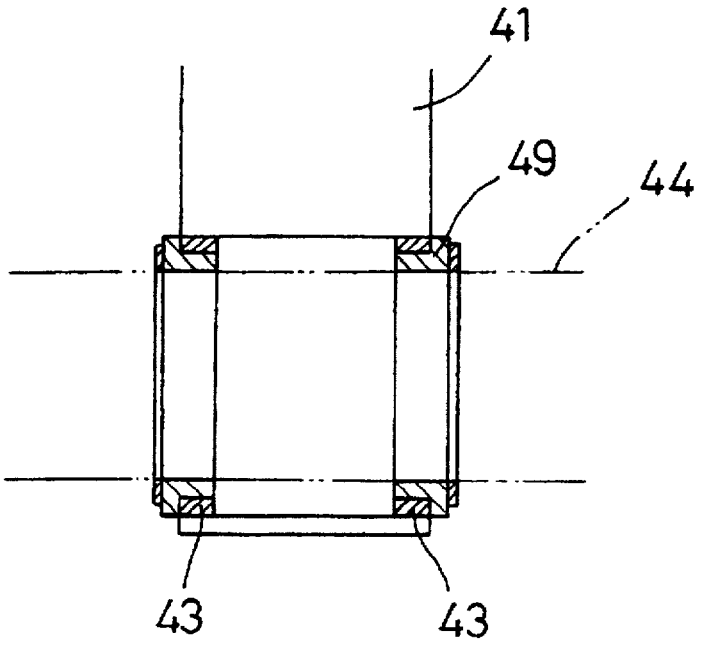
Figure 11:
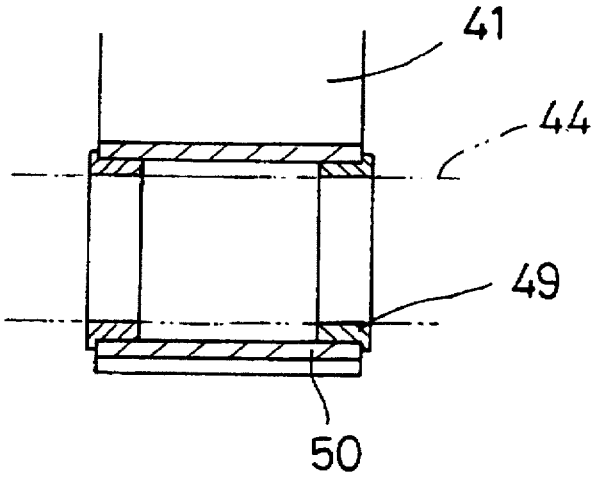

While the supporting bracket 43 attached to the coupler 41 is supported to the support shaft 44 through a thrust ball bearing in this embodiment, it may be supported to the support shaft 44 by friction engagement, using a bearing bush 49 as shown in FIG. 10 in place of the thrust ball bearing. In this case, the supporting bracket 43 attached to the coupler 41 may be replaced with a supporting block 50, and the bearing bush 49 is forced into a hole defined in the supporting block 50, whereby the support shaft 44 can be supported by the bearing bush 49 as shown in FIG. 11.

In this embodiment, the upstream and downstream tractors 2, 3 are secured to the coupler 41 by fixing them to the claws 42,42 disposed in the ends of the coupler is using screws. An alternative is such that two claws are disposed so as to project from the coupler 41 and with these claws, the tractors 2, 3 are pinched.

(3) Paper delivery knob construction

Figure 12:
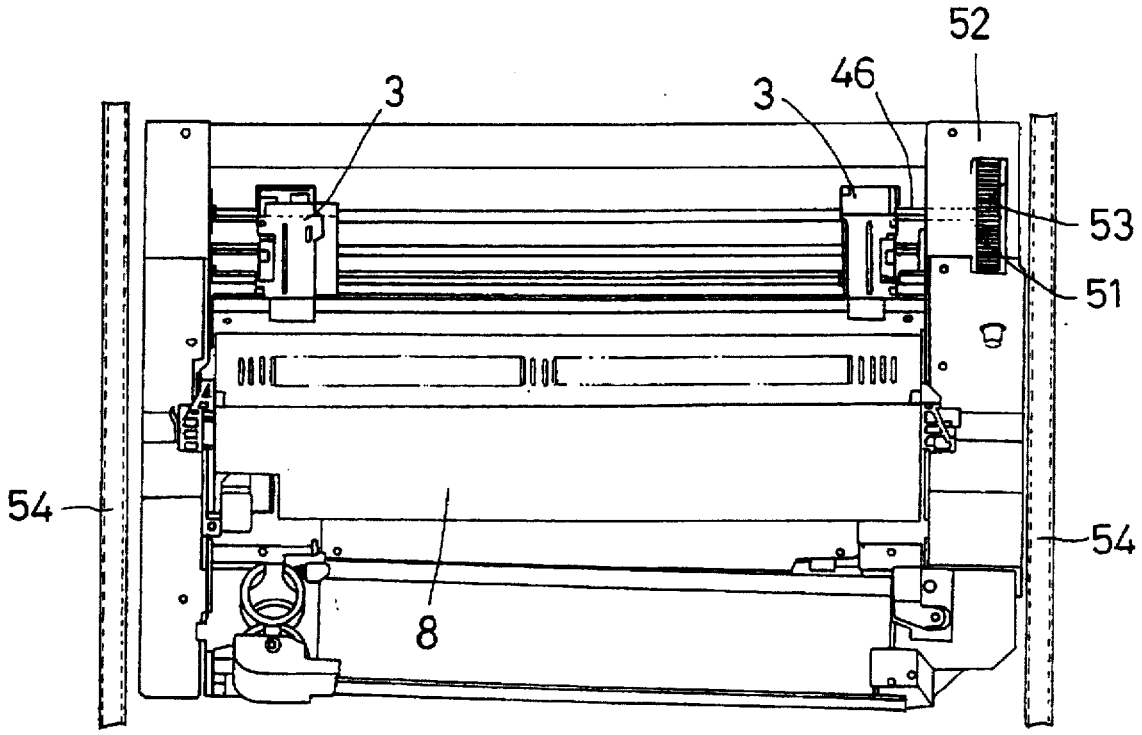
Figure 13:
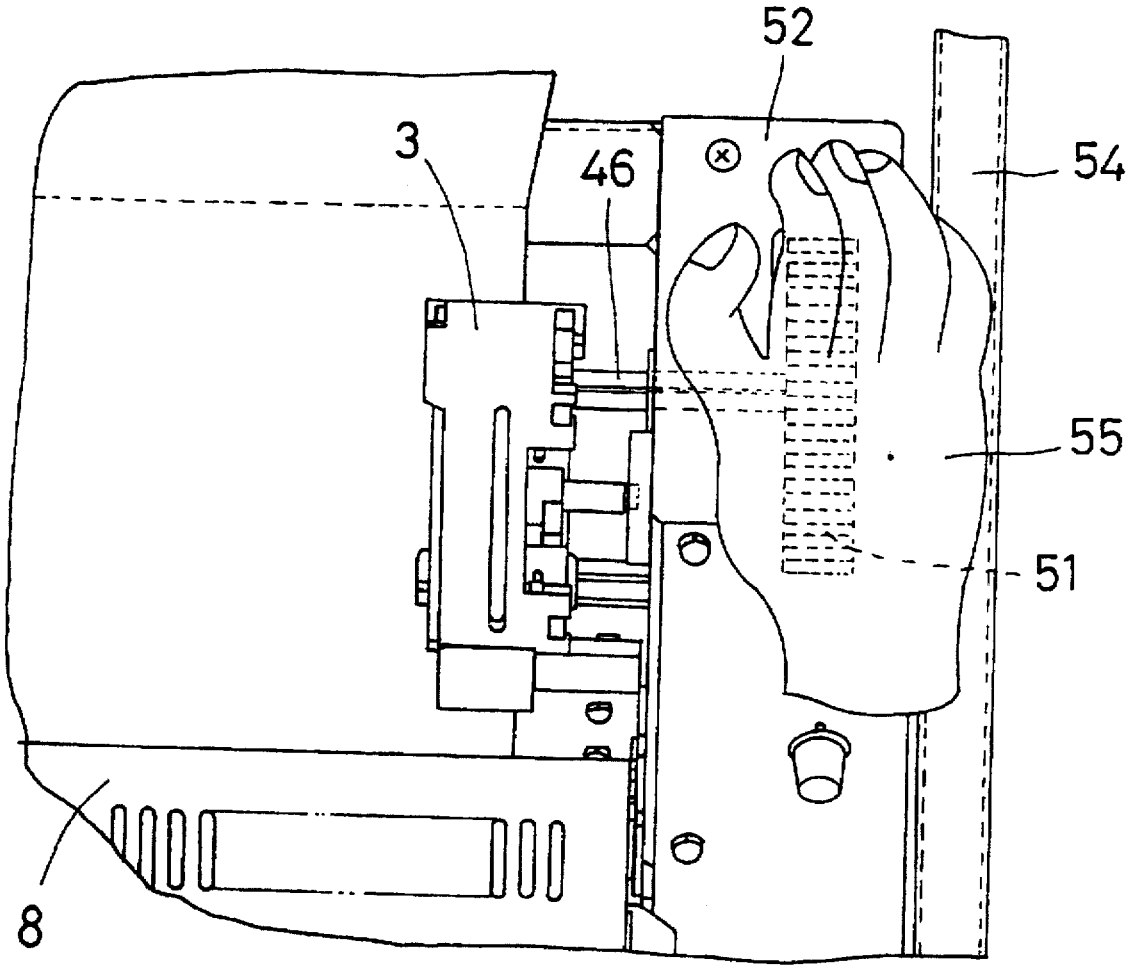
Figure 14:
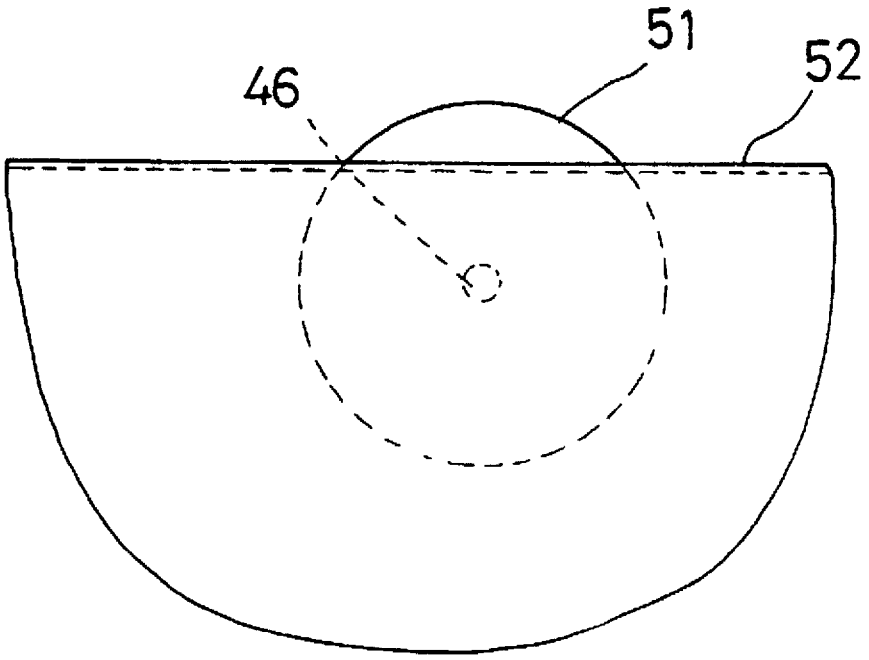

As shown in FIGS. 12 to 14, a paper delivery knob 51 is attached to the drive shaft 46 of the downstream tractor 3 for rotating the drive shaft 46 by manual operation. The paper delivery knob 51 has a diameter fitting to the palm of an operator's hand, say, about 90 to 100 mm. A part (e.g., about 15 to 25 mm) of the knob 51 projects upward through a hole 53 defined in a machine body cover 52. On the side of the machine body cover 52 adjacent the paper delivery knob 51, there is provided a rocker 54 which serves as a table for supporting the operator's hand placed thereon. It is preferable that the rocker 54 be disposed, for example, about 5 to 25 mm away from the outer face of the paper delivery knob 51.

When operating the paper delivery knob 51, a hand 55 is placed on the top face of the rocker 54 with the palm put on the paper delivery knob 51, so that the knob 51 can be turned by the palm to easily set the paper 4 at a desired position through manual operation. The above-described knob 51 can be installed in a narrow space, compared with a conventional-type knob which is operated by a finger from the side of the machine. The construction of the knob 51 reduces the width of the machine, making the entire machine compact. In addition, the knob 51 can be easily operated with less power even in a narrow space, which contributes to an improvement in operability for paper delivery.

(4) Paper delivery control unit

In the impact printer according to this embodiment, the distance between the upstream tractor 2 and the downstream tractor 3 is shorter than a multiple of the pitch (this pitch is ½ inch in general) of the tractor holes in the paper 4 by a length which is less than the pitch (i.e., by 0.1 to 12.7 mm). With such arrangement, the phase of the tractor pins 18 of the downstream tractor 3 is shifted from the phase of the tractor pins 18 of the upstream tractor 2 by a length with in the range of 0.1 to 12.7 mm, and as a result, a slack of 0.1 to 12.7 mm is caused in part of the paper 4 situated between the tractors 2 and 3. During automatic loading of the paper 4, the lead end of the paper 4 reaches the downstream tractor 3, being pushed from the back by the upstream tractor 2 and the delivery rollers 7, and then the tractor pins 18 of the downstream tractor 3 receive the tractor holes provided at the lead end of the paper 4 so that the tractor pins 18 are smoothly inserted into the tractor holes. At that time, the delivery rollers 7 are driven at a speed equal to or faster than the speed of the tractors 2, 3. Upon completion of automatic loading, the delivery rollers 7 are stopped to apply back tension to the paper 4.

With reference to the flow chart of FIG. 15, the procedure of the control during automatic loading of the paper 4 will be described.

Steps S1 and S2:

When the machine is stopped (i.e., the off-line condition where the start switch is turned off), the paper 4 is hooked over the tractor pins 18 of the upstream tractor 2 and the automatic loading switch is turned on.

Steps S3 to S5:

When the trail end detection sensor (not shown) disposed between the paper hopper and the upstream tractor is turned on, the platen 9 of the printing unit 10 is retracted to a predetermined position by means of the stepping motor 14, and then the upstream tractor 2 and the downstream tractor 3 are actuated by the first delivery motor 11 while the delivery rollers 7 are actuated by the second delivery motor 12.

Figure 16:
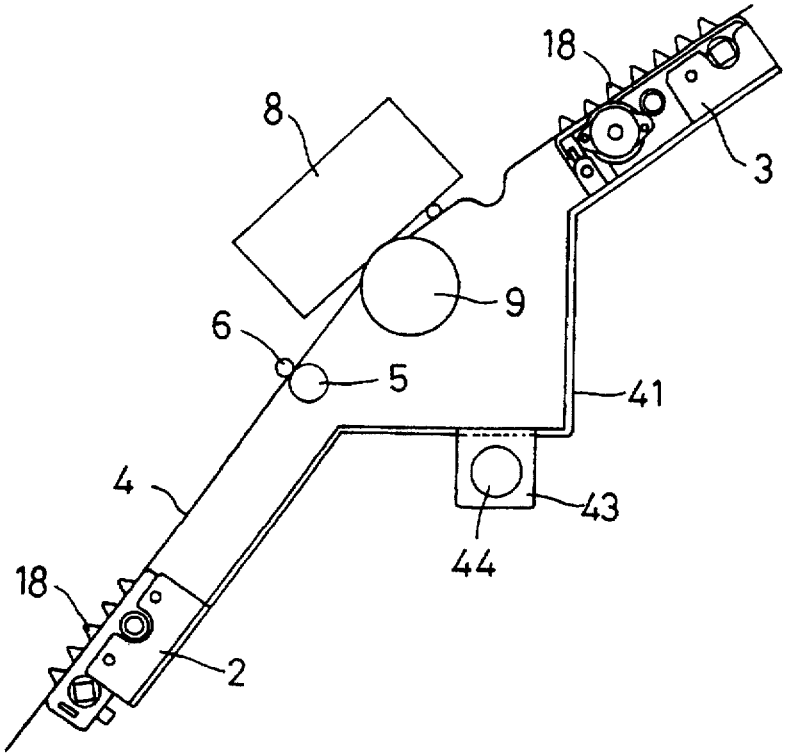
Figure 17:
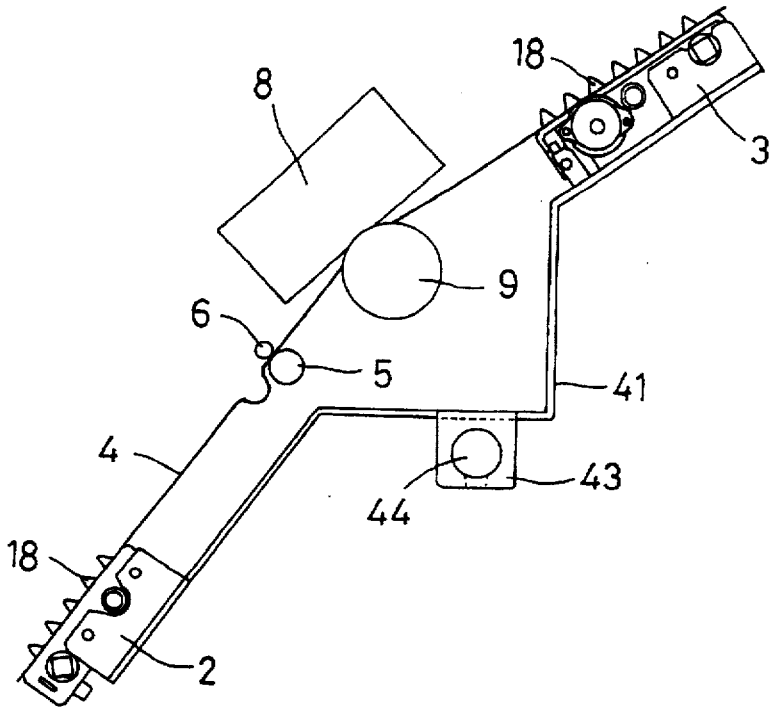
Figure 18:
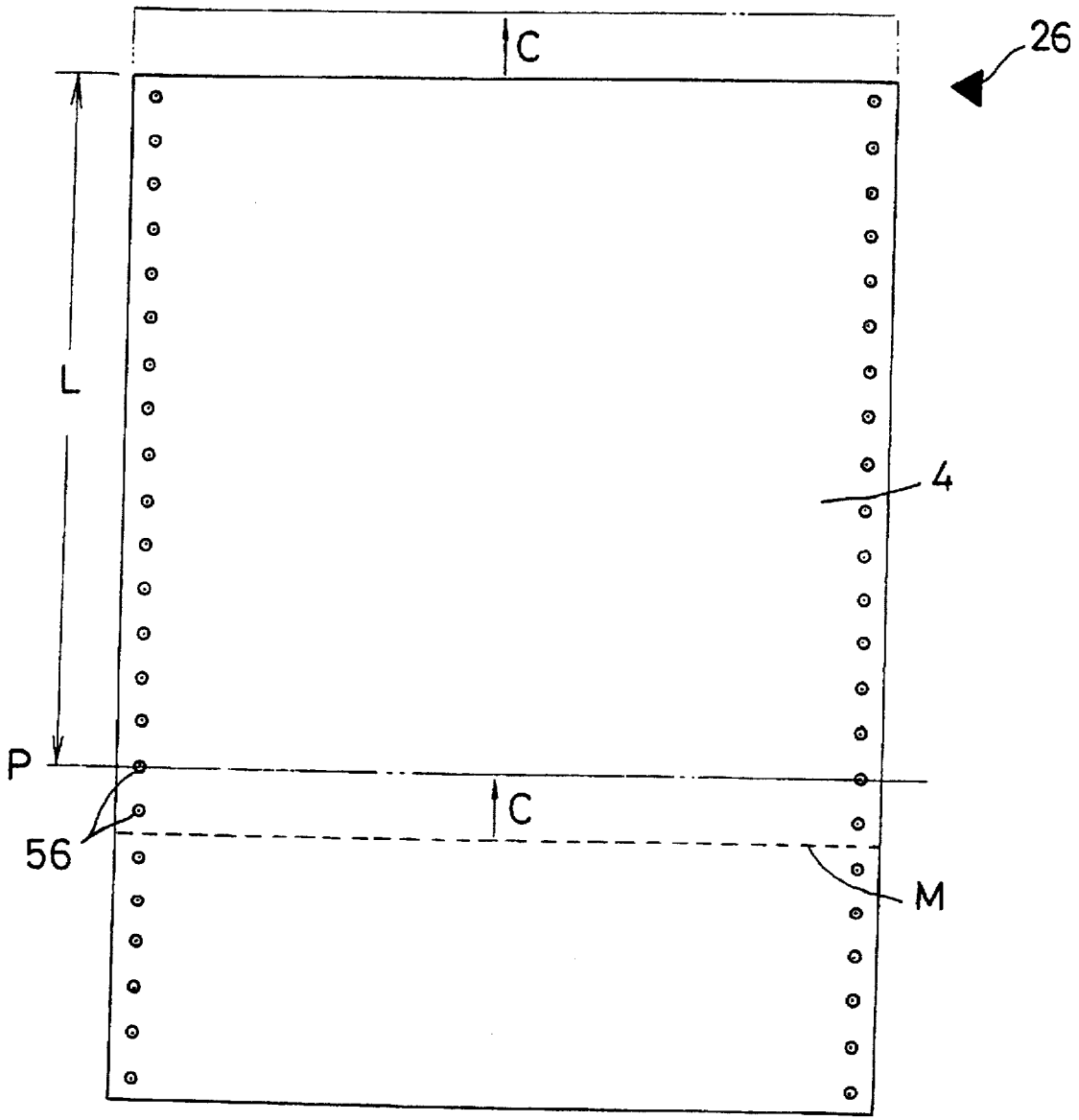

Steps S6 to S9:

When the lead end of the paper 4 has reached a predetermined position in the downstream tractor 3 and the jam detection sensor 27 and the paper lead end detection sensor 28 have been turned on, the delivery rollers 7 are stopped, and the paper 4 is delivered until its lead end reaches the mark 26 of the downstream tractor 3. After the lead end has reached the mark 26, the tractors 2, 3 are stopped. Just before the stop of the delivery rollers 7, the paper 4 is in a slack condition between the delivery rollers 7 and the downstream tractor 3 as shown in FIG. 16, because of the phase difference between the upstream tractor 2 and the downstream tractor 3 (the length of this slack is equivalent to the phase difference). After the stop of the delivery rollers 7, the slacked portion of the paper 4 moves to a position between the upstream tractor 2 and the delivery rollers 7 as shown in FIG. 17, because back tension is applied to the paper 4 by the delivery rollers 7. In this way, the delivery basis for the paper 4 is changed from the lower tractor (upstream tractor) basis (see FIG. 16) to the upper tractor (downstream tractor) basis (see FIG. 17). In the case of the upper tractor basis, the tractor pins 18 of the downstream tractor are positioned at the front rims of tractor holes 56. As shown in FIG. 18, the distance L of the paper delivery path between the mark 26 (=the stop position of the paper 4 upon completion of automatic loading) and the printing position P is set to a length obtained by adding half of the pitch of the tractor holes of the paper 4 to a multiple of the pitch (i.e., n/2+¼ inch (n=constant)).

Step S10:

An automatic printing gap adjustment mechanism 57 (described later) is set in operation to adjust the gap between the platen 9 and the printing head 8 according to the thickness of the paper 4. It should be noted that as the printing position P is separated from the mark 26 by the distance L, gap adjustment is carried out over the tractor holes 56. It means that there are no perforations, paper stapler and glue where gap adjustment is carried out and therefore errors in the detection of paper thickness can be prevented to ensure reliable gap adjustment. Further, gap adjustment is carried out after eliminating paper slack in this embodiment, so that printing gap can be adjusted appropriately. This leads to an improvement in print quality and securely prevents troubles such as a snap of the printing head pin.

Steps S11 and S12:

If the paper lead end detection sensor 28 is not turned on even when a preset time has elapsed, the paper 4 is reversely delivered to the upstream tractor 2 to execute automatic loading again on condition that the number of executed automatic loading operations has not reached a predetermined value.

Step S13:

If the paper trail end detection sensor is turned off, it means that the paper 4 within the paper hopper has run out. Therefore an alarm is allowed to blare thereby informing the run-out of the paper 4. If the jam detection sensor 27 is not turned on and the paper lead end detection sensor 28 is not turned on even when automatic loading has been repeated a predetermined number of times, it means that there has occurred trouble in the delivery of the paper 4 so that an alarm is allowed to blare informing paper jam in automatic loading.

Figure 19:
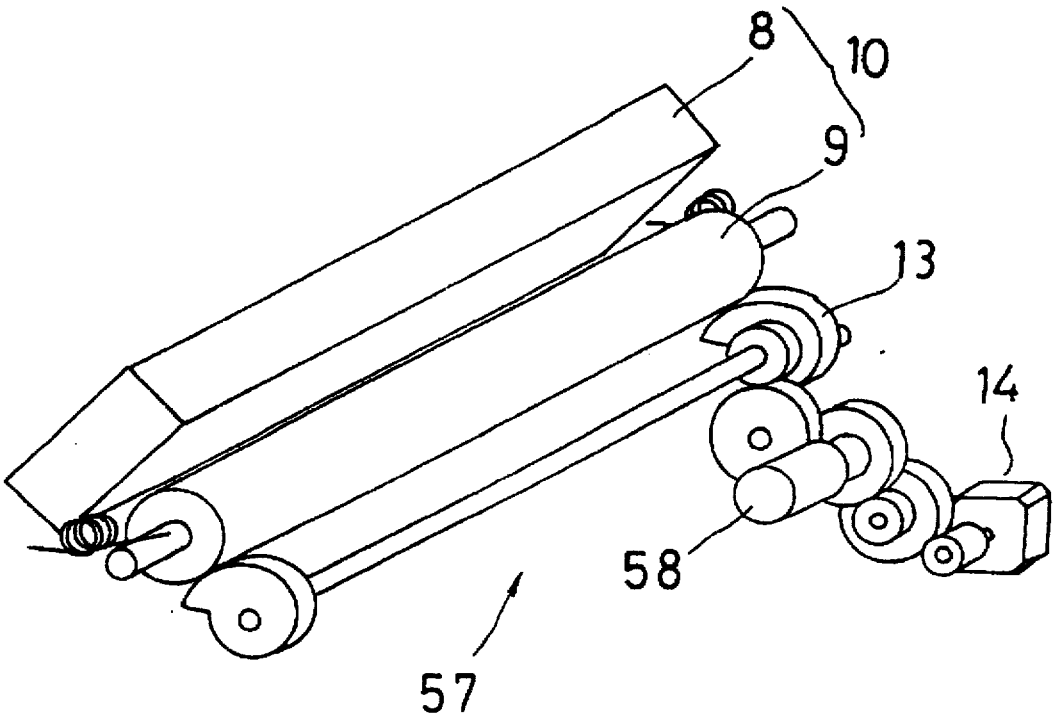

Next, one form of the automatic printing gap adjustment mechanism 57 will be described referring to FIG. 19. In the example shown in FIG. 19, there is provided a torque limiter 58 in the middle of a gear system for transmitting driving force from the stepping motor 14 to the cam 13. The torque limiter 58 interrupts the transmission of driving force to the cam 13 when torque more than a predetermined value has been applied to the cam 13. The stepping motor 14 is provided with a counting means for counting how many steps the stepping motor 14 has moved.

Printing gap adjustment by the automatic printing gap adjustment mechanism 57 having the above-described construction is performed in the following way.

Figure 20:
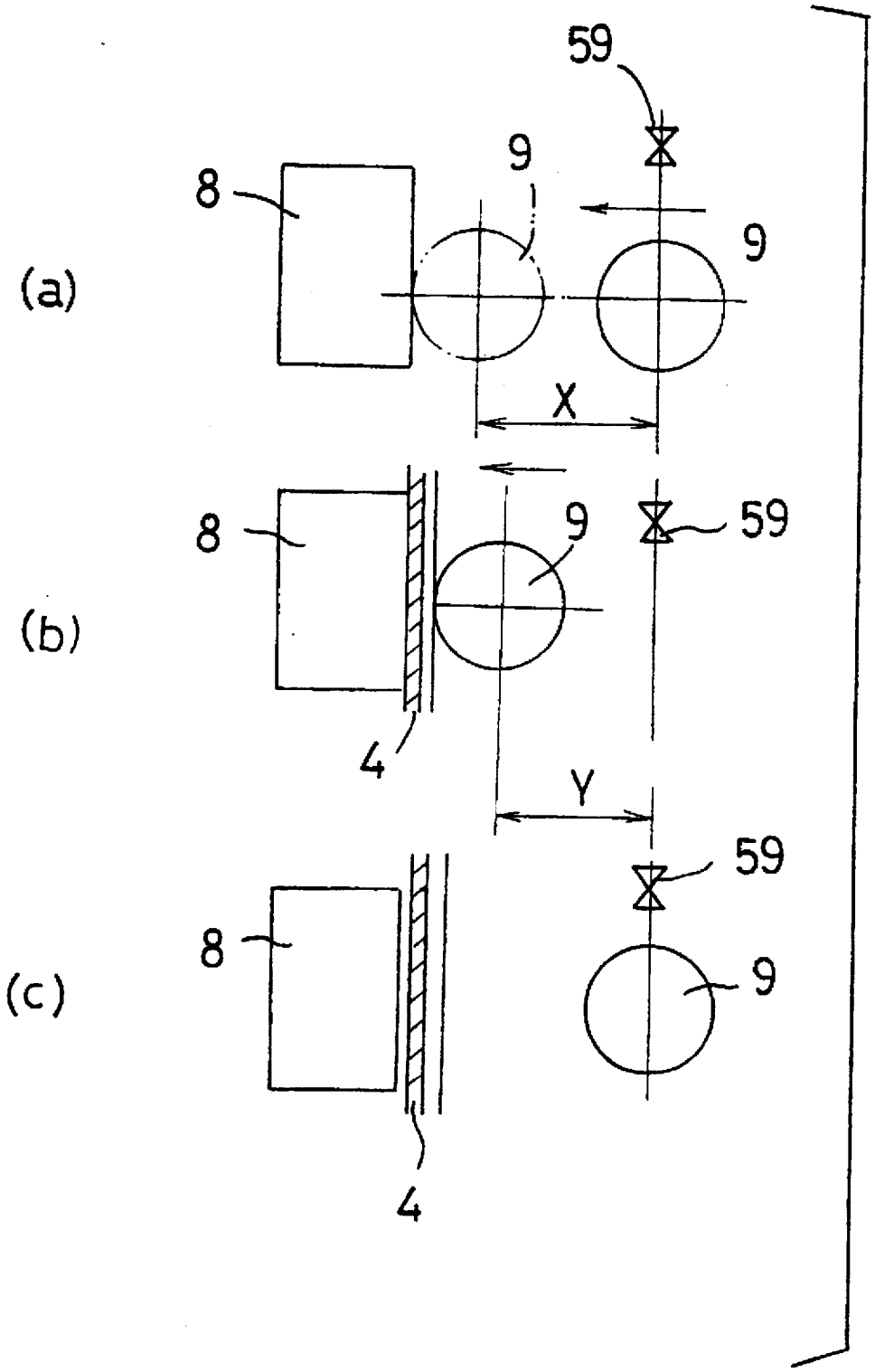

As shown in FIG. 20(*a*), the distance X between the home position of the platen 9 preliminarily detected by a home position sensor 59 and the position (indicated by chain line) where the platen 9 is in contact with the printing head 8 is memorized by counting the number of steps which the stepping motor 14 has moved. After the paper 4 has been delivered between the printing head 8 and platen 9 and stopped at a predetermined position for printing while the platen 9 is retracted from the printing head 8, the stepping motor 14 is actuated so that the cam 13 rotates to press the platen 9 against the printing head 8 as shown in FIG. 20(*b*). When the torque of the cam 13 reaches the predetermined value after the platen 9 has been pressed, the transmission of driving force to the cam 13 is interrupted by the torque limiter 58. Then, the stepping motor 14 is reversely rotated so that the platen 9 returns to the home position as shown in FIG. 20(*c*). The retracting distance Y of the platen 9 is determined by obtaining how many steps the stepping motor 14 has moved between the time the reverse rotation of the stepping motor 14 started from the condition where the platen 9 was pressed and the time the home position of the platen 9 was detected. The thickness of the paper 4 is calculated by subtracting the distance Y from the distance X, and an appropriate printing gap is obtained through calculation based on this thickness.

Figure 21:
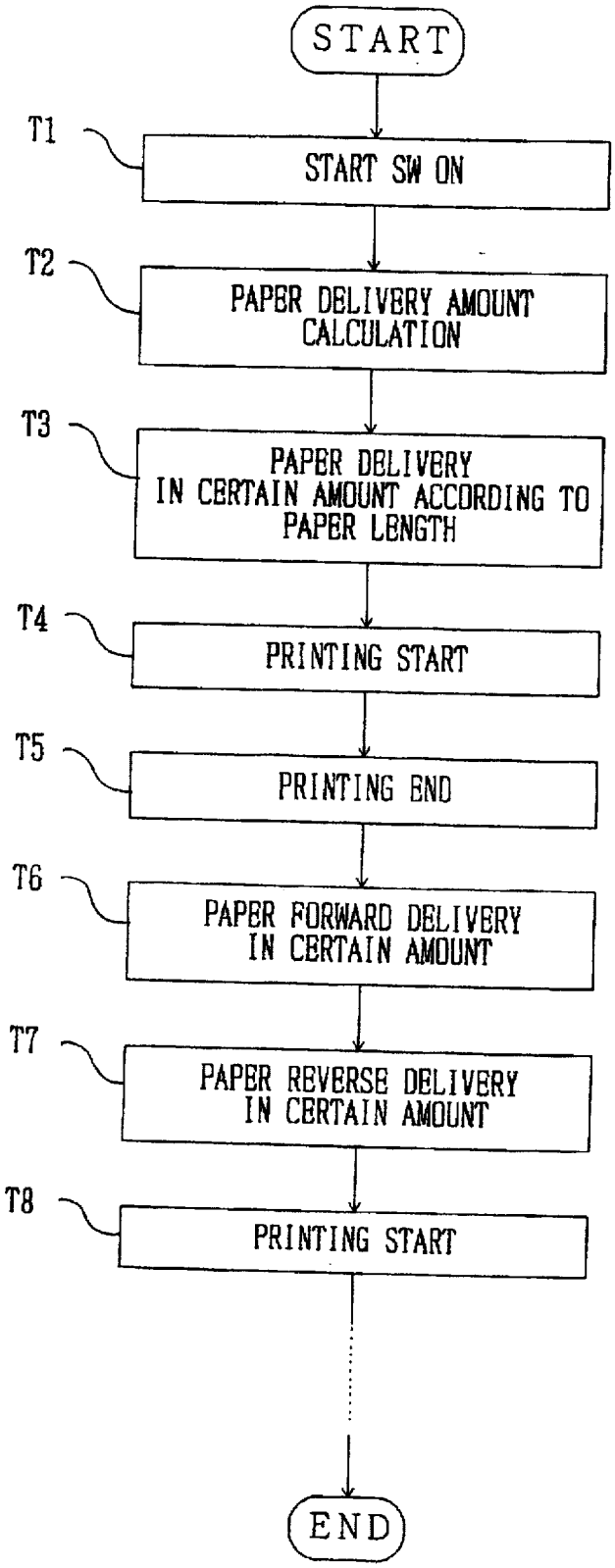

Referring now to the flow chart of FIG. 21, the procedure of the control during normal printing after automatic loading will be described.

Steps T1 to T3:

After completion of automatic loading of the paper 4, the lead end of the paper 4 is positioned at the mark 26 of the downstream tractor 3. If the start switch is turned on in the above condition, the mode of the machine is changed to On-line mode so that the delivery amount of paper is computed according to page length data on the particular paper which has been preliminarily input by paper length input means, and the paper 4 is delivered by a certain amount from its lead end until the perforations M (on the second page or afterward) come in line with the printing position P (see arrow C in FIG. 18). In cases where the paper 4 is manually delivered, for example, when the paper 4 is cut at perforations, the paper 4 can be delivered by a certain amount like the case described above by turning the start switch on, with the paper lead end positioned at the mark 26.

In this case, the delivery direction of the paper 4 is not necessarily limited to forward direction. If the perforations M of the paper 4 are positioned downstream the printing position P with respect to the paper delivery direction after completion of automatic loading, the paper 4 can be reversely delivered in accordance with the page length data on the paper 4 until the perforations M on the second page or afterward come in line with the printing position P as far as the paper 4 does not come off the downstream tractor 3.

Steps T4 and T5:

Printing is started by the printing unit after a release of a printing start instruction and terminated after a release of a printing end instruction.

Steps T6 to T9:

After a specified time has elapsed after completion of printing, the paper 4 is forwardly delivered by the distance L (=the distance between the printing position P and the mark 26 of the downstream tractor 3), which allows the operator to check the last printed page. When the next printing start instruction has been released, the paper 4 is reversely delivered by an amount equal to the distance L by which the paper 4 has been delivered at the time of forward delivery. This allows the next printing to start in a condition in which the perforations are in line with the printing position P.

The control operation when printing is started from the top page of the paper 4 (i.e., top page printing) will be described below. In top page printing, the paper 4 is reversely delivered after completion of automatic loading until the lead end of the paper 4 comes in line with the printing position P and thereafter, printing is started. During top page printing, the paper 4 is delivered on the lower tractor (upstream tractor) basis by means of the upstream tractor 2 and the delivery rollers 7 at the initial stage. After the paper 4 has been hooked over the downstream tractor 3, the delivery rollers 7 are stopped and delivery basis is switched to the upper tractor (downstream tractor) basis. During the paper delivery on the lower tractor basis, the delivery rollers 7 are driven at a speed faster than the delivery speed of the upstream tractor 2. This prevents oblique movement of the paper 4 between the upstream tractor 2 and the delivery rollers 7, so that improved print quality can be achieved. It should be noted that it can be determined by the user through presetting a set-up mode whether top page printing or normal printing (i.e., printing in a condition where the paper 4 is hooked over the tractor pins 18 of the downstream tractor 3) is to be performed.

Referring to the flow chart of FIG. 22, the procedure of the control in top page printing will be described.

Figure 15:
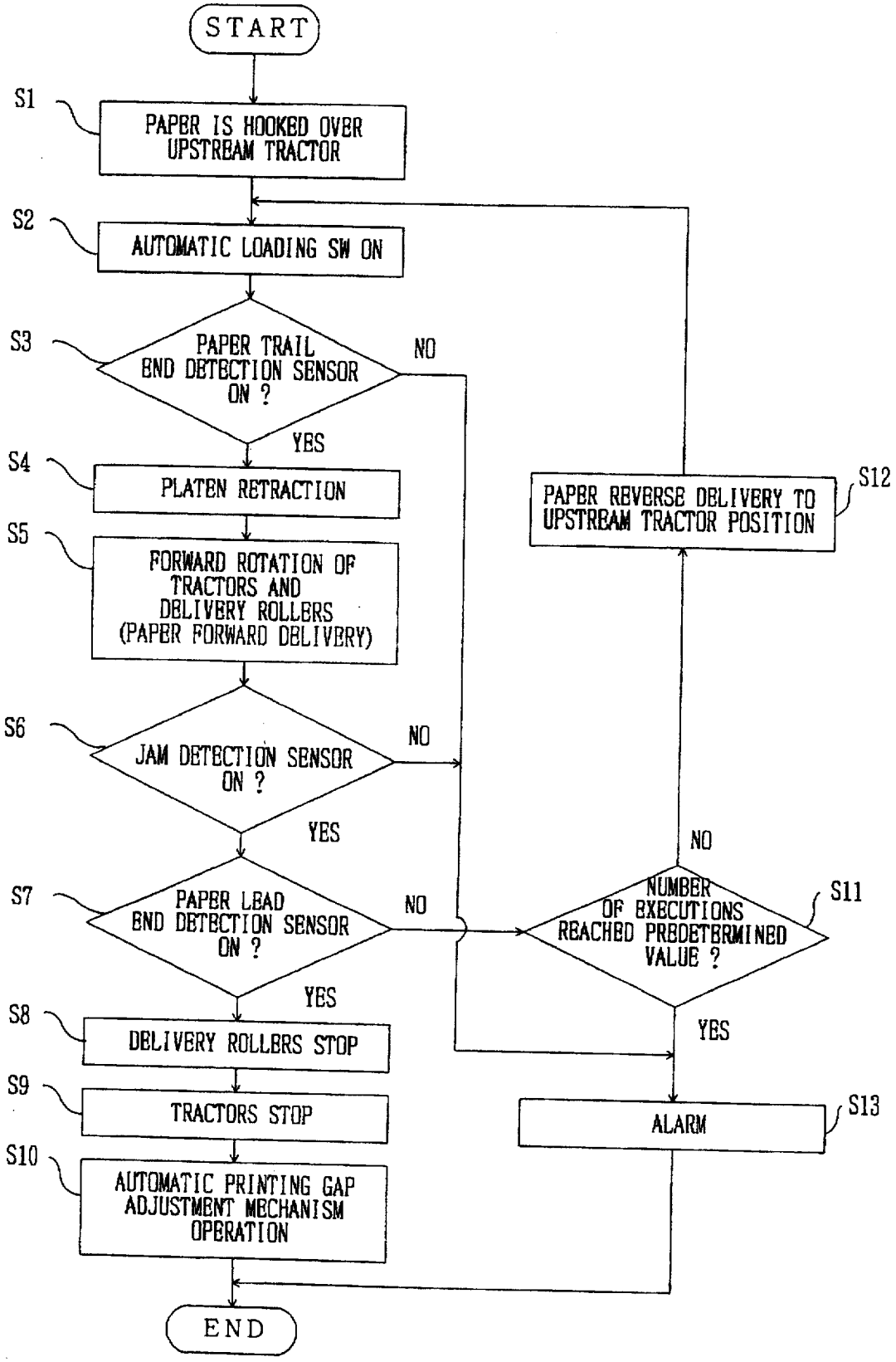

Steps U1 to U10:

These steps are the same as Steps S1 to S10 of the control in automatic loading shown in FIG. 15, and therefore detailed description will be omitted.

Step U11:

The upstream tractor 2 and the downstream tractor 3 are reversely rotated (for backward delivery of the paper) from a condition where the paper 4 is hooked over the tractor pins 18 of the downstream tractor 3.

Steps U12 to U14:

After the paper lead end detection sensor 28 has been turned off, the upstream tractor 2 and the downstream tractor 3 are further reversely rotated to backwardly deliver the paper 4 by a predetermined distance, and when the lead end of the paper 4 reaches the printing position P, the upstream tractor 2 and the downstream tractor 3 are stopped.

Step U15:

Printing is started when the CPU has released a printing start instruction. It should be noted that during top page printing, the paper 4 is delivered by the upstream tractor 2 and the delivery rollers 7 on the lower tractor (upstream tractor) basis until the paper 4 is hooked over the downstream tractor 3 and the delivery rollers 7 are stopped.

Step U16:

If it is determined in Step U3 that the paper trail end detection sensor has been turned off, it means that the paper 4 within the paper hopper has run out, so that an alarm blares, informing the run out of the paper 4. If it is determined in Step U6 that the jam detection sensor 27 is not turned on, if its is determined in Step U7 that the paper lead end detection sensor 28 is not turned on or if it is determined in Step U12 that the paper lead end detection sensor 28 is not turned off even by the reverse rotation of the tractors, it means that there has occurred trouble in the delivery of the paper 4. Therefore, an alarm is allowed to blare, informing the jammed condition.

Figure 23:
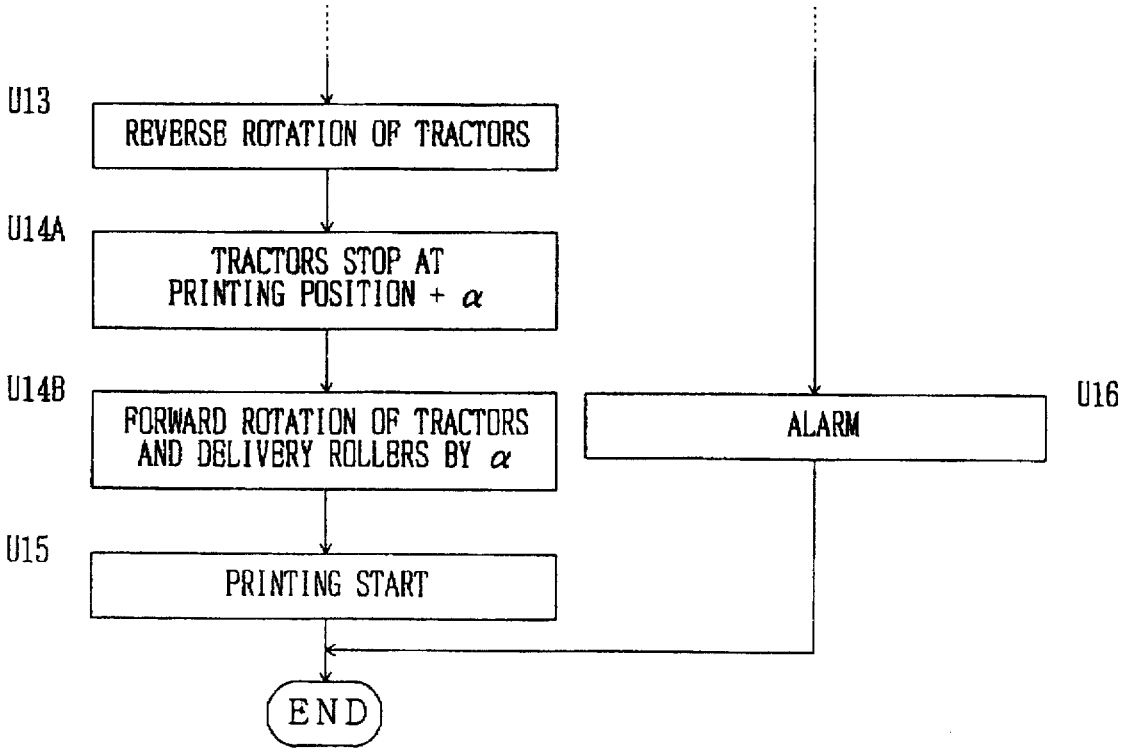

Referring to the flow chart of FIG. 23, a modified example of the control in top page printing will be described. In this example, Step U14 of the foregoing flow chart is replaced with Steps U14A and U14B in order to eliminate the effects of backlash in the belts, gears and motors incorporated in the upstream tractor 2, the downstream tractor 3 and others. Other steps of this example are the same as the foregoing flow chart.

Steps U14A to U14B:

After the paper lead end detection sensor 28 has been turned off, the upstream tractor 2 and the downstream tractor 3 are reversely rotated, and after the lead end of the paper 4 has reached the printing position P, the tractors 2, 3 are reversely rotated further by an amount a equivalent to the backlash. Then, the upstream tractor 2, the downstream tractor 3 and the delivery rollers 7 are forwardly rotated by the amount $\alpha$, thereby eliminating the backlash.

As noted earlier, since the paper 4 is not hooked over the downstream tractor 3 during top page printing, the paper 4 is delivered on the basis of the upstream tractor 2. In view of print quality, though, it is better that the paper 4 is delivered on the basis of the downstream tractor 3, being tensioned between the downstream tractor 3 and the delivery rollers 7 (as can be seen in FIG. 17), because such a condition is more effective in preventing slight deflection of the paper 4. However, when paper delivery is changed from the upstream tractor (lower tractor) basis to the downstream tractor (upper tractor) basis, there occurs printing shifts so that correction becomes necessary to eliminate the printing shifts. In this example, the timing of switching from the lower tractor basis to the upper tractor basis, in other words, the timing of stopping the delivery rollers 7, is set to the time when the perforations between pages of the paper 4 have come in line with the printing position P. With this arrangement, printing shifts caused when paper delivery is changed from the lower tractor basis to the upper tractor basis can be corrected.

Figure 24:
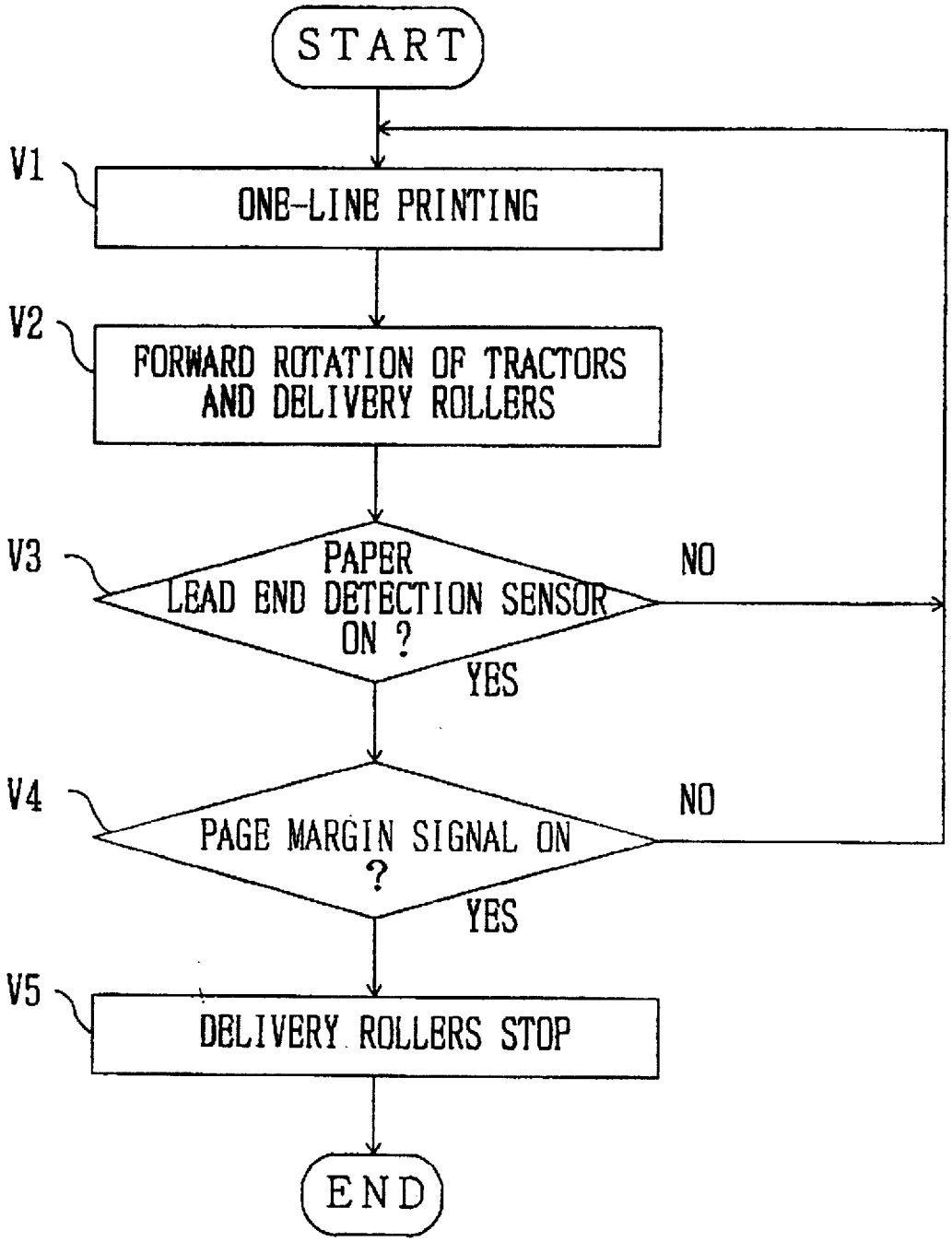

Next, printing shift correction will be described with reference to the flow chart of FIG. 24.

Steps V1 to V3:

In top page printing, one-line printing is performed in response to a release of a printing start instruction and then, the upstream tractor 2, the downstream tractor 3 and the delivery rollers 7 are forwardly rotated at the same time to forwardly deliver the paper 4. Until the paper lead end detection sensor 28 has been turned on, such one-line printing and paper delivery are repeated.

Steps V4 and V5:

After the paper lead end detection sensor 28 has been turned on, the paper 4 is delivered on the lower tractor basis until a paper margin signal released from the CPU becomes ON. After the paper margin signal has become ON, the delivery rollers 7 are stopped, thereby to switch to the upper tractor basis. When a margin between pages has come to the printing position, switching of the tractor basis is thus performed and correction of printing shifts is performed in a non-printing area, i.e., a margin between pages. After the printing shift correction, normal printing can be performed.

Figure 25:
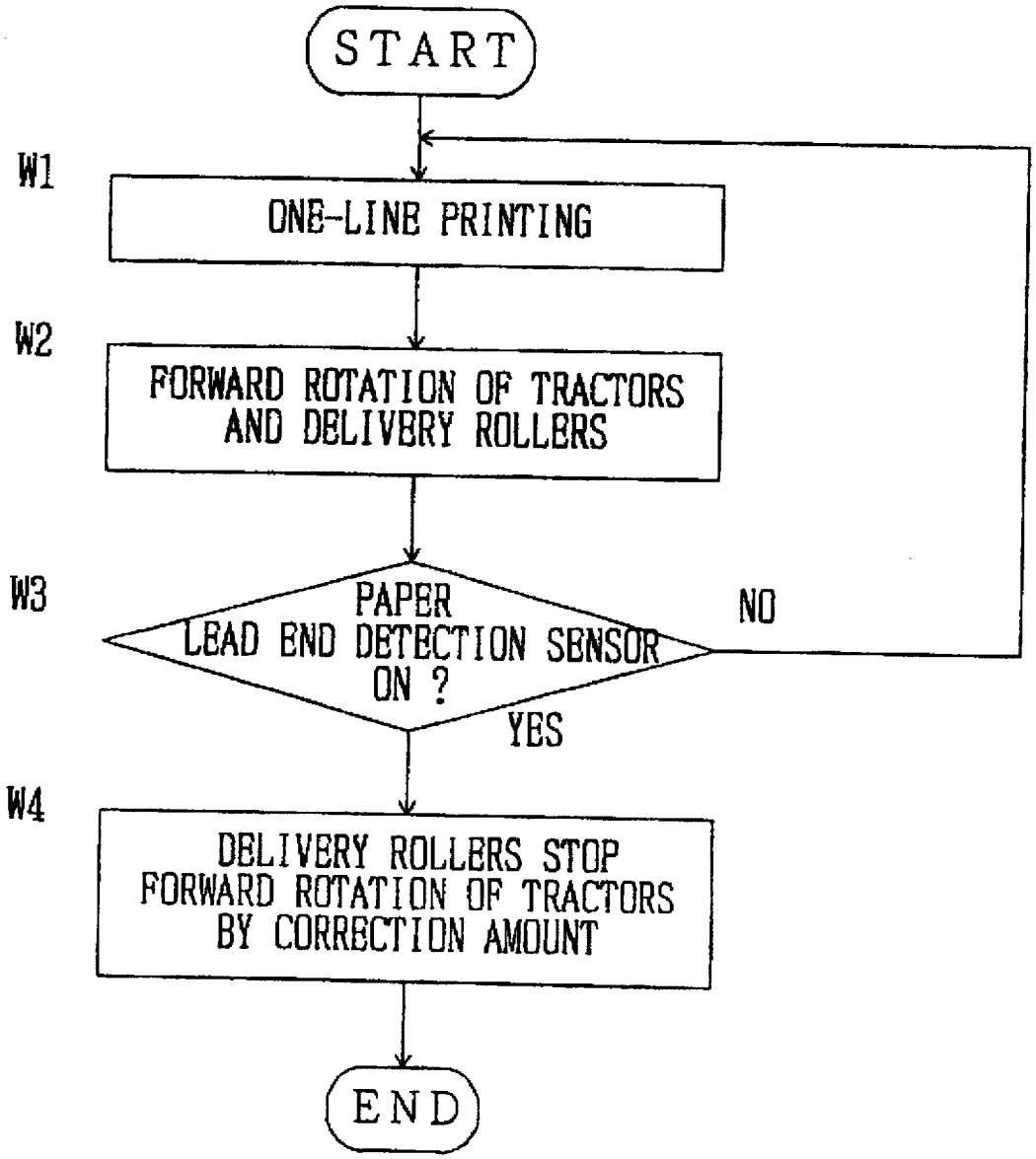

Although printing shift correction is performed in a page margin in the foregoing description, it may be performed on the same page after hooking of the paper 4 over the downstream tractor 3 has been detected. Printing shift correction according to such another example will be described referring to the flow chart of FIG. 25.

Steps W1 to W3:

In top page printing, one-line printing is performed in response to a release of a printing start instruction, and then the upstream tractor 2, the downstream tractor 3 and the deliver), rollers 7 are forwardly rotated at the same time to forwardly deliver the paper 4. Until the paper lead end detection sensor 28 has been turned on, such one-line printing and paper delivery are repeated.

Step W4:

After the paper lead end detection sensor 28 has been turned on whereby hooking of the paper 4 over the downstream tractor 3 has been detected, the delivery rollers 7 are stopped, and the upstream tractor 2 and the downstream tractor 3 are forwardly rotated by an amount (=correction amount) equal to the phase difference between the upstream tractor 2 and the downstream tractor 3 in relation to the paper 4, to change delivery basis to the upper tractor basis. After printing shift correction, normal printing is performed.

In top page printing described above, print quality considerably varies according to whether the paper 4 is firm or not. Specifically, when infirm paper such as thin or narrow paper is used, the printing head unsteadily moves, causing the paper 4 to be shaken laterally. This results in extremely poor print quality. In order to solve this problem, this example is designed such that the firmness of the paper 4 is detected, and in the case of infirm paper, top page printing is interrupted even if a top page printing instruction is released.

Figure 22:
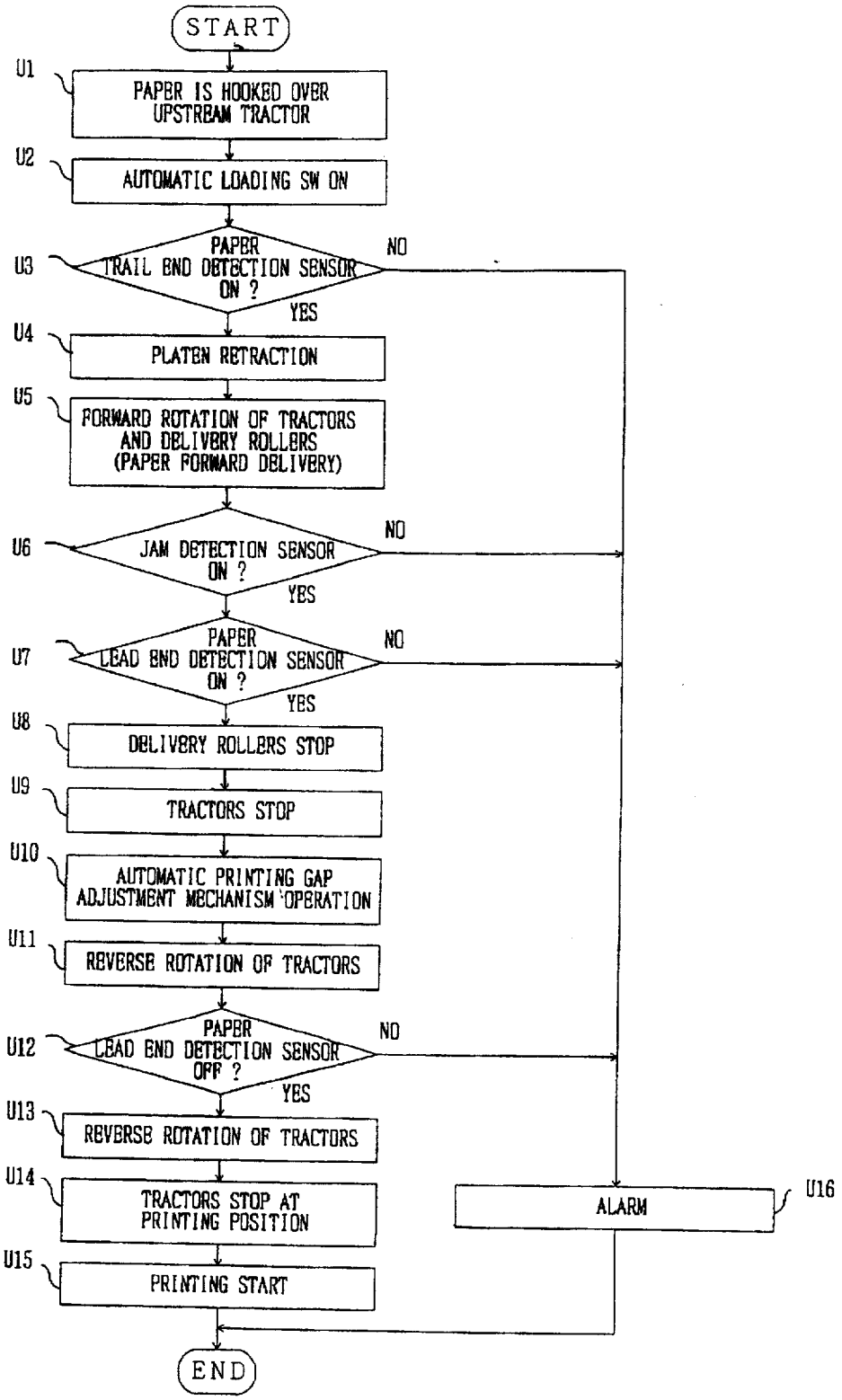

As noted earlier (see FIG. 20), the thickness of the paper 4 is measured while the automatic gap adjustment mechanism is operated (i.e., Step U10 in FIG. 22). If the thickness of the paper to be used is less than a predetermined value, top page printing is interrupted even when a top page printing instruction has been released, so that normal printing will be performed from the second page onward.

Figure 26:
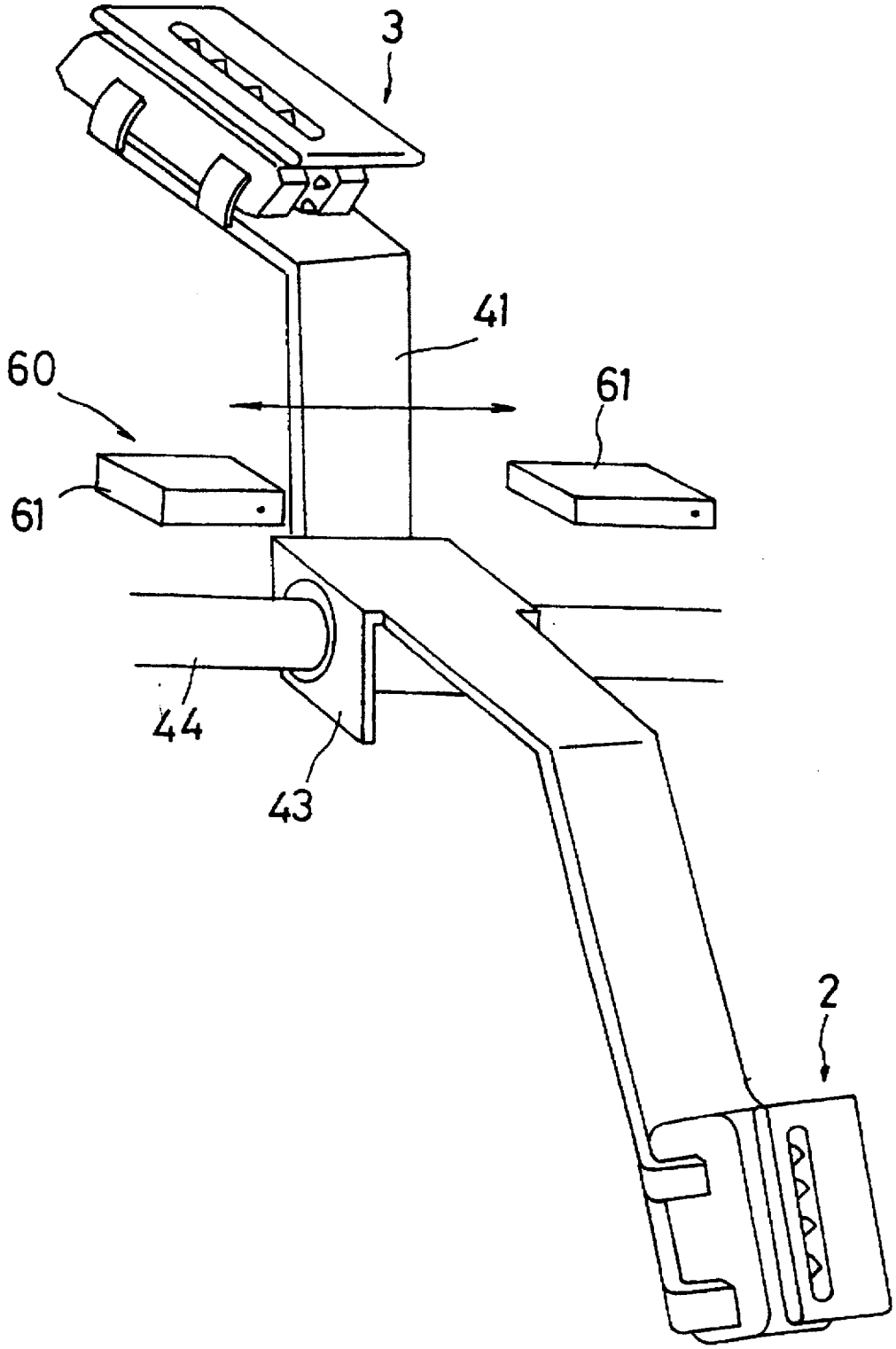

The width of the paper 4 is detected by a paper width detection mechanism 60 shown in FIG. 26. The paper width detection mechanism 60 is designed such that when the positions of the right members of the upstream tractor 2 and the downstream tractor 3, the right members being located at the right hand when viewed in the paper delivery direction, are adjusted in the direction of arrow in FIG. 26 by means of the tractor slide mechanism as shown in FIG. 8, the position of the coupler 41 or the position of the supporting bracket 43 is detected by a width detection sensor 61, thereby detecting the change of paper width. Such a width detection sensor 61 may be a transmission-type sensor or a reflection-type photosensor or a micro switch which directly comes in contact with the coupler 41 etc. As mentioned earlier, when the width of the paper to be used is less than a predetermined value, top page printing is interrupted to start normal printing from the second page onward even when a top page printing instruction has been released. Note that measurement data on paper width is sent to the CPU by the time the operation of the automatic gap adjustment mechanism is completed.

The predetermined value for paper thickness or paper width used for judging whether top page printing is continued or interrupted is preliminarily stored in the CPU, and this predetermined value stored in the CPU may be corrected by the user through an operator panel or the like.

When a medium composed of sheets irregular in level such as slips used by delivery service companies is used as the paper 4 in top page printing, for example, paper delivery and printing operation sometimes cannot be smoothly carried out. In order to overcome this problem, provision of a top page printing mode for such a medium is required. The procedure of the control during top page printing for irregular-level medium will be explained with reference to the flow chart of FIG. 27.

Steps X1 to X5:

In top page printing, one-line printing is performed in response to a release of a printing start instruction, and then the platen 9 is retracted to provide the paper delivery path. Thereafter, the upstream tractor 2, downstream tractor 3 and delivery rollers 7 are forwardly rotated at the same time to forwardly deliver the paper 4 by one line. The automatic printing gap adjustment mechanism 57 is then operated to obtain a proper printing gap while paper thickness is detected. If the paper lead end detection sensor 28 is not turned on, Steps X1 to X4 are repeated again. If the paper lead end detection sensor 28 is not turned on even when the paper 4 has been delivered to the position where the sensor 28 is normally turned on, an alarm blares (this step is not shown in the flow chart).

Steps X6 to 8:

After the paper lead end detection sensor 28 has been turned on, normal printing is started with the judgment that top page printing has been completed. In this normal printing, one-line printing and paper delivery with the delivery rollers 7 being stopped are repeated. At the time no printing instruction is released from the CPU, the normal printing operation is stopped.

By performing top page printing according to the above-described flow, deflection of the paper during paper delivery can be prevented to ensure good print quality. In addition, even if an irregular-level medium comes to the printing position as a first page, printing can be smoothly performed.

Figure 28:
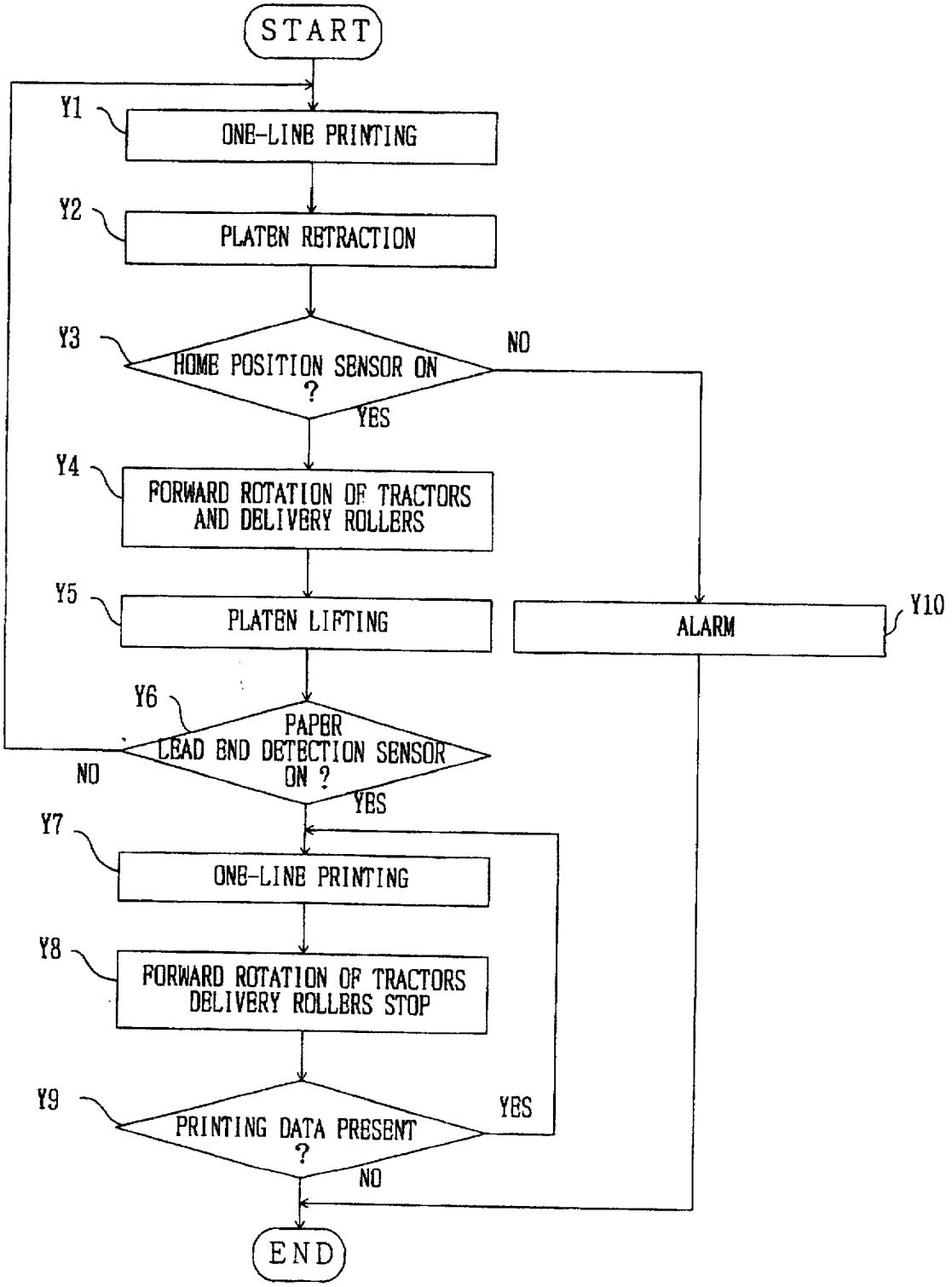

Reference is made to the flow chart of FIG. 28 to describe the procedure of the control in top page printing of irregular-level medium according to a modified example.

Steps Y1 to Y3:

In top page printing, one-line printing is performed in response to a release of a printing start instruction, and then the stepping motor 14 is reversely rotated to retract the platen 9 until the home position sensor 59 (see FIG. 20)) is turned on so that the paper delivery path is provided. During the retraction of the platen 9, it is calculated and measured how many steps the stepping motor 14 has moved by the time the home position sensor 59 is turned on.

Steps Y4 to Y6:

The upstream tractor 2, the downstream tractor 3 and the delivery rollers 7 are forwardly rotated at the same time to forwardly deliver the paper 4 by one line. Then, the stepping motor 14 is forwardly rotated (the number of rotations is equal to the number of steps stored in the memory) to raise the platen 9. After that, if the paper lead end detection sensor 28 is not turned on, Steps Y1 to Y5 are repeated again. If the paper lead end detection sensor 28 is not turned on even when the paper 4 has been delivered to the position where the sensor 28 is normally turned on, an alarm blares (this step is not shown in the flow chart).

Steps Y7 to Y9:

After the paper lead end detection sensor 28 has been turned on, normal printing is started with the judgment that top page printing has been completed. In this normal printing, one-line printing and paper delivery with the delivery rollers 7 being stopped are repeated. At the time no printing instruction is released from the CPU, the normal printing operation is stopped.

Step Y10:

If the home position sensor 59 is not turned on even when the platen 9 is retracted in Step Y2, an alarm blares and the flow is terminated.

Figure 27:
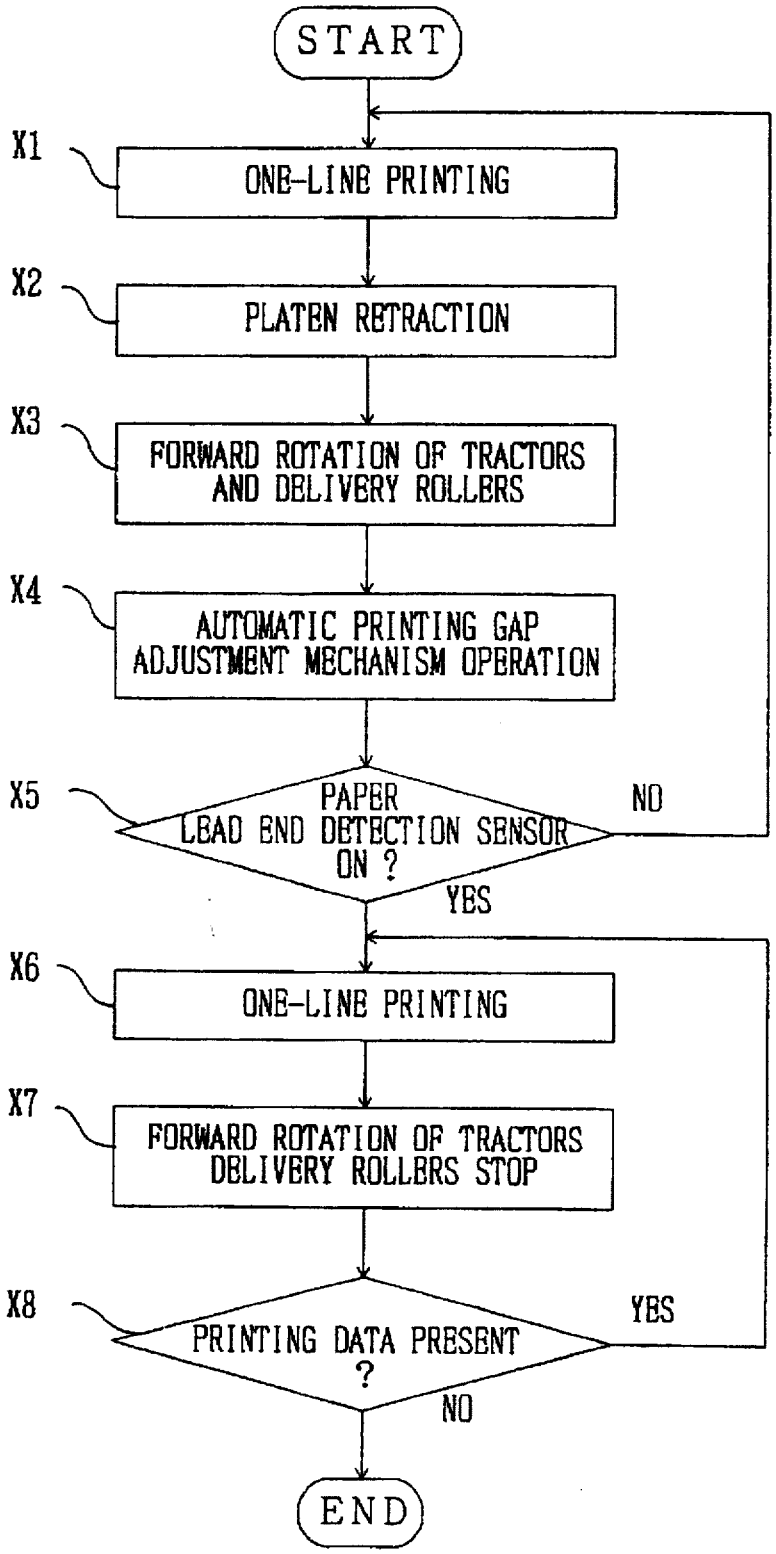

Processing time required for printing gap adjustment can be reduced by the control of the above modified example, compared to the control shown in FIG. 27, and therefore processing time for top page printing can be shortened as a whole.

Preferably, the control in top page printing of irregular-level medium is performed on condition that paper thickness preliminarily detected is not less than a predetermined value and that paper width preliminarily detected is not less than a predetermined value.

Top page printing after completion of automatic loading has been particularly described in the foregoing description. It should be understood that when delivering the paper 4 by manual operation, top page printing like the foregoing example can be started by selecting the top page printing mode with the lead end of the paper 4 set in line with the position of the mark 26.

In the foregoing embodiment, since the mark 26 used for paper alignment is provided on the top face of the tractor lid 21 of the downstream tractor 3, there is no need to employ a scale which is used for alignment in conventional systems. This makes it possible to easily and accurately perform paper lead end alignment by the paper delivery knob 51.

In the foregoing embodiment, the amount of paper delivery after turning-on of the paper lead end detection sensor 28 until stop of the paper 4 during automatic loading varies depending on machines. Therefore, a switch for correcting variations may be employed, and the amount of paper delivery may be adjusted with this switch.

Figure 29:
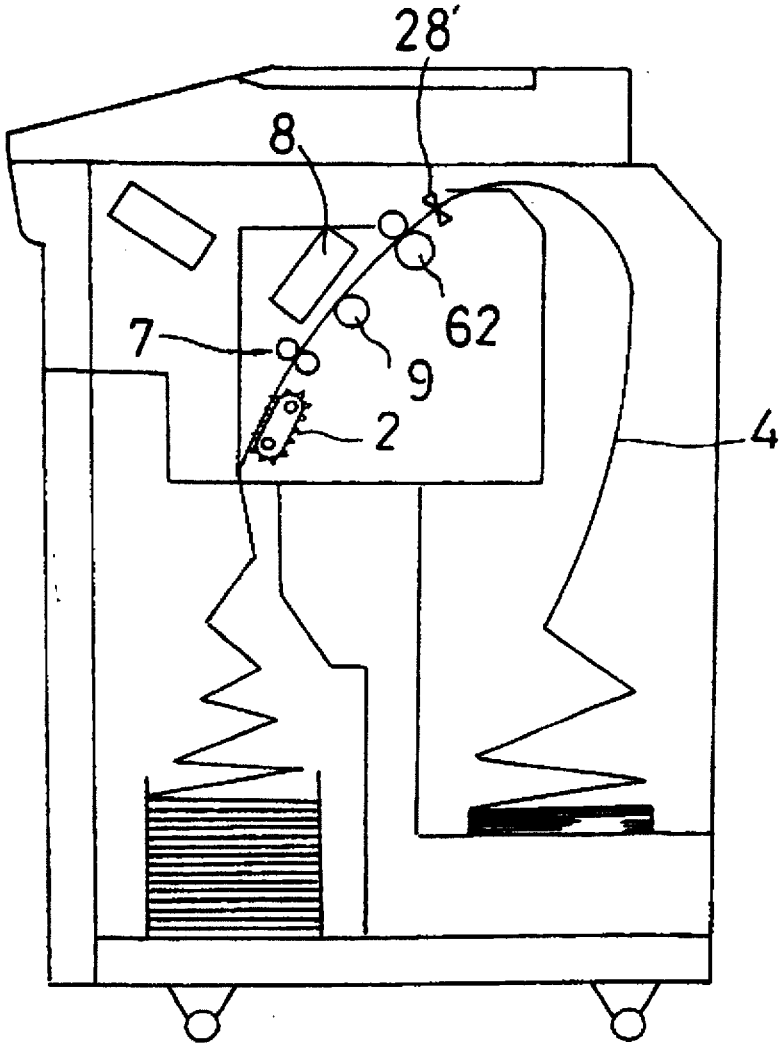

In the paper delivery control system according to the foregoing embodiment, there are provided, as the paper delivery means, an upstream tractor and a downstream tractor which are disposed upstream and downstream the printing unit respectively. However, the downstream tractor may be replaced with paper send rollers 62 (see FIG. 29) composed of a delivery roller and a pinch roller which deliver the paper held therebetween. Where the paper send rollers 62 are used as the downstream delivery means, a paper leading end detection sensor 28' is disposed on the downstream side of the paper send rollers 62. In such a case, the control of the paper send rollers 62 at the time of automatic loading or top page printing is performed similarly to the control of the downstream tractor 3 in the foregoing embodiment.

(5) Delivery guide mechanism

Figure 30:
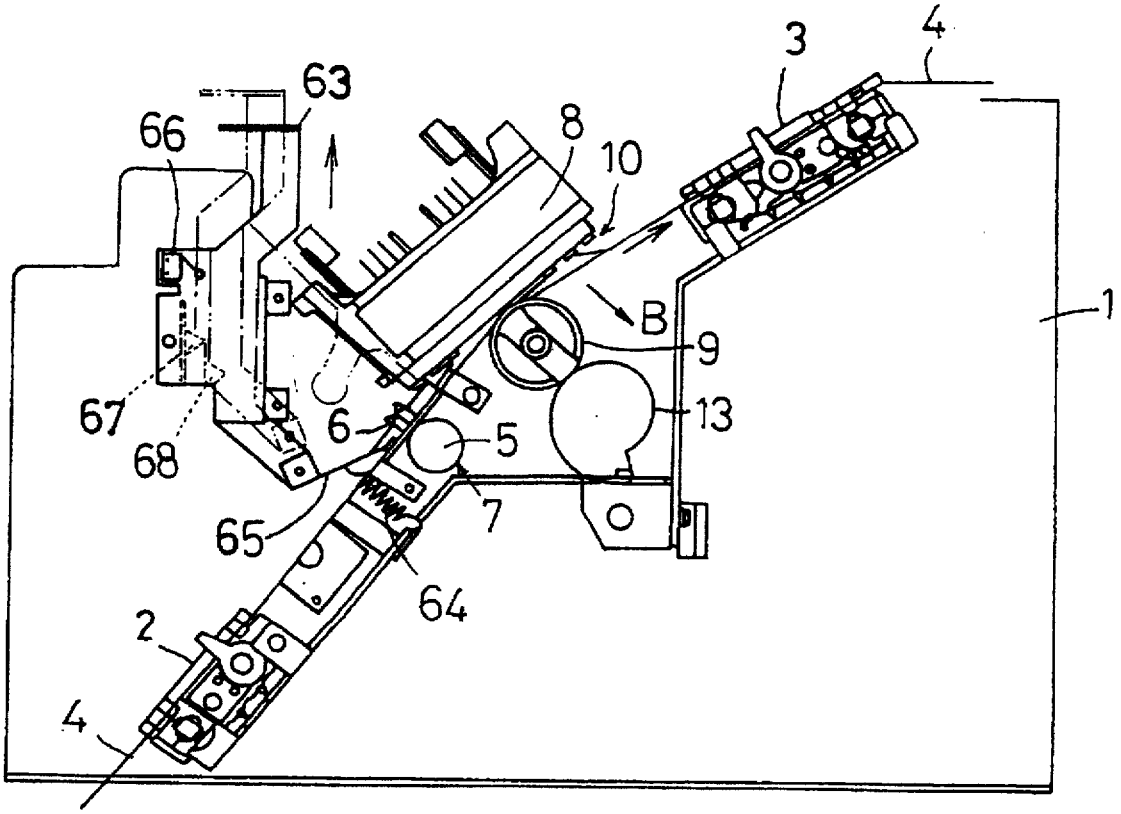
Figure 31:
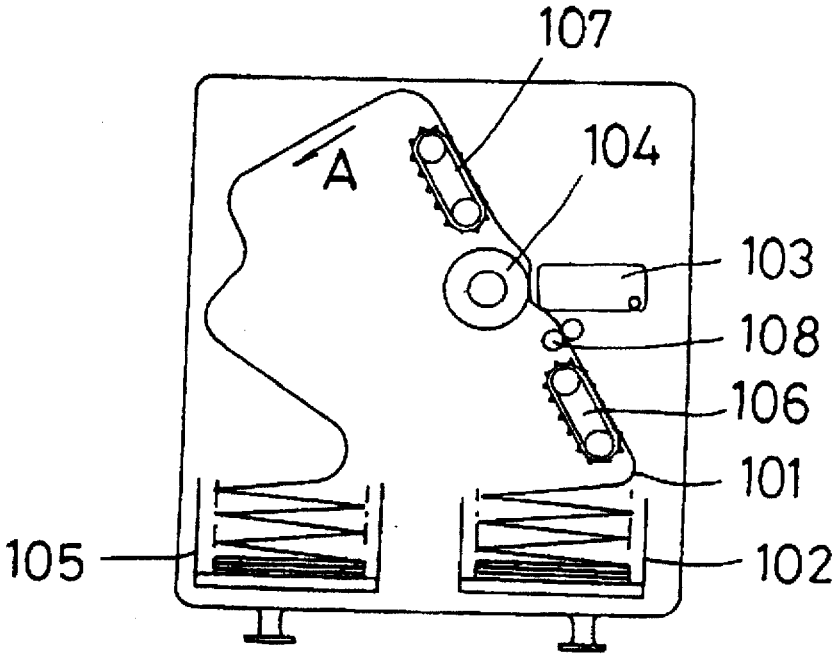
PRIOR ART FIG. 31

As shown in FIG. 30, the pinch roller 6 constituting a part of the delivery rollers 7 of this embodiment is pivotably supported to the lower end of a throat lever 63 which is so journaled in a slit (not shown) as to be vertically movable. The pinch roller 6 is also held at the lead end of a delivery guide 65 which is energized at all times by a tension coil spring 64 toward the drive roller 5. When disposing paper jam, the throat lever 63 is pulled up from the position indicated by solid line to the position indicated by chain line, opposing the energizing force of the tension coil spring 64. This allows the paper 4 to be released from the hold by the pinch roller 6 and the drive roller 5. When pulling the throat lever 63 up, a micro switch 66 is operated so that driving of the upstream tractor 2, downstream tractor 3 and delivery rollers 7 is stopped, while the cam 13 is actuated to move the platen 9 in the direction of arrow B toward its retracted position. When the throat lever 63 is brought into its pulled-up condition, a projection 67 disposed on the machine body frame 1 comes into engagement with a notch 68 formed in the throat lever 63 thereby to hold the throat lever 63 in the pulled-up condition. After disposal of paper jam, the throat lever 63 is forced down so that the projection 67 gets out of engagement with the notch 68, and thus the delivery guide 65 returns to the initial position with the help of the energizing force of the tension coil spring 64.

In the delivery guide mechanism of this embodiment, the delivery system can be retracted simply by pulling up the throat lever 63 positioned in the upper part of the machine, and therefore very good operability can be ensured at the time of paper jam disposal.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A paper delivery system having a printing unit with an upstream tractor and a downstream tractor disposed on an upstream side and a downstream side of said printing unit with respect to a paper delivery direction to said printing unit, said system having a coupler for coupling said upstream tractor and said downstream tractor to each other, and a support shaft for supporting said coupler so that said coupler is movable in a direction transverse to said paper delivery direction, a resilient member positioned between said coupler and a fixed frame of said printing unit for energizing said coupler in a predetermined direction for constantly holding said coupler at a certain position in relation to said support shaft.

2. The paper delivery system as claimed in claim 1, further comprising (a) a lock shaft which penetrates through at least either the upstream tractor or the downstream tractor, and (b) a lock means for locking the tractor through which the lock shaft penetrates to the lock shaft.

3. The paper delivery system as claimed in claim 2, wherein the lock shaft and the lock means are provided only for the downstream tractor.

4. The paper delivery system as claimed in claim 1, wherein the upstream tractor and the downstream tractor are secured to at least one claw by means of a screw, the claw member being disposed on said coupler and projects therefrom.

5. The paper delivery system as claimed in claim 1, wherein the upstream tractor and the downstream tractor are secured to said coupler, and are pinched by claw members disposed on said coupler and project therefrom.

* * * * *